US005795835A

United States Patent [19]

Bruner et al.

[11] Patent Number: 5,795,835

[45] Date of Patent: Aug. 18, 1998

[54] BONDED COMPOSITE KNITTED STRUCTURAL TEXTILES

[75] Inventors: Jeffrey W. Bruner, Greensboro, N.C.; Peter E. Stevenson, Easley, S.C.

[73] Assignee: The Tensar Corporation, Atlanta, Ga.

[21] Appl. No.: 696,604

[22] Filed: Aug. 14, 1996

Related U.S. Application Data

[63] Continuation-in-part of Ser. No. 520,018, Aug. 28, 1995, abandoned.

[51] Int. Cl.[6] ..... B32B 5/08

[52] U.S. Cl. ..... 442/310; 442/313; 442/314

[58] Field of Search ..... 428/197, 253, 428/296; 442/308, 310, 313, 314

[56] References Cited

U.S. PATENT DOCUMENTS

| | | | |
|---|---|---|---|
| 3,481,371 | 12/1969 | Row | 139/383 R |
| 3,517,514 | 6/1970 | Visser | 405/19 |
| 3,561,219 | 2/1971 | Nishizawa et al. | 405/19 |
| 3,928,696 | 12/1975 | Wandel et al. | 405/19 X |
| 3,998,988 | 12/1976 | Shimomai et al. | 428/400 |
| 4,116,743 | 9/1978 | Davis | 156/333 |
| 4,374,798 | 2/1983 | Mercer | 264/288.8 |
| 4,388,364 | 6/1983 | Sanders | 428/253 |
| 4,421,439 | 12/1983 | ter Burg et al. | 405/258 |
| 4,428,698 | 1/1984 | Murphy et al. | 404/17 |
| 4,434,200 | 2/1984 | Fash et al. | 428/257 |
| 4,469,739 | 9/1984 | Gretzinger et al. | 428/198 |
| 4,472,086 | 9/1984 | Leach | 405/258 |
| 4,497,863 | 2/1985 | Cogan, Jr. | 428/253 |
| 4,521,131 | 6/1985 | Nandlal | 405/15 X |
| 4,535,015 | 8/1985 | Bruner et al. | 428/44 |
| 4,540,311 | 9/1985 | Leach | 428/489 |
| 4,563,382 | 1/1986 | Viel | 428/198 |
| 4,608,290 | 8/1986 | Schnegg | 428/101 |
| 4,610,568 | 9/1986 | Koerner | 405/15 X |
| 4,623,281 | 11/1986 | Verbauwhede et al. | 405/19 |
| 4,636,428 | 1/1987 | Bruner et al. | 428/254 |

(List continued on next page.)

FOREIGN PATENT DOCUMENTS

| | | |
|---|---|---|
| 7127395 | 12/1985 | Taiwan . |
| WO95/21965 | 8/1995 | WIPO . |

OTHER PUBLICATIONS

Tai Chia-pin et al, "Construction and Materials", T'ienyu Press, Taipei City, Jun. 15, 1992, pp. 10–20 to 10–25 (w/trans).

(List continued on next page.)

*Primary Examiner*—Jenna Davis

*Attorney, Agent, or Firm*—Jacobson, Price, Holman & Stern, PLLC

[57] ABSTRACT

Bonded composite knitted structural textiles are formed of knitted polymeric fibers. The textile is formed from at least two, and preferably three or four, polymeric components. The first component, or load bearing member, is a high tenacity, high modulus, low elongation mono- or multifilament yarn. The second component is a fusible polymer in yarn or other form which will encapsulate and bond adjacent load bearing yarns. The third component is an optional effect or bulking yarn. The fourth component is a conventional multifilament warp knit stitch forming yarn to form the ground structure of the knitted textile. Knitted textiles of the present invention may be formed by any conventional knitting technique, i.e., weft insertion warp knitting, warp insertion weft knitting, and warp and weft insertion knitting. At least a portion of the laid-in warp and/or weft yarns are first component load bearing yarns. Specific and, if desired, periodically varying strength characteristics may be created in the finished product by varying the number, location and type of fiber component yarns. The second encapsulating and bonding polymer component is used as required to improve the structural integrity, initial modulus, stiffness and durability of the finished product. The effect or bulking yarns are used as laid-in warp and/or weft yarns as required to increase the bulk and cross-sectional profile of the finished product to improve its effectiveness in mechanically and frictionally resisting movement when embedded in construction fill materials.

80 Claims, 13 Drawing Sheets

U.S. PATENT DOCUMENTS

| | | | |
|---|---|---|---|
| 4,643,119 | 2/1987 | Langston et al. | 112/421 |
| 4,724,179 | 2/1988 | Schnegg | 428/101 |
| 4,837,387 | 6/1989 | van de Pol | 428/229 |
| 4,840,832 | 6/1989 | Weinle et al. | 428/156 |
| 4,841,749 | 6/1989 | Patracek et al. | 66/190 |
| 4,844,969 | 7/1989 | Chang | 5/186 R |
| 4,845,963 | 7/1989 | Parekh | 66/170 |
| 4,960,349 | 10/1990 | Willibey et al. | 405/262 |
| 5,056,960 | 10/1991 | Marienfeld | 405/270 |
| 5,091,247 | 2/1992 | Willibey et al. | 428/255 |
| 5,100,713 | 3/1992 | Homma et al. | 139/383 R |
| 5,104,703 | 4/1992 | Rachman et al. | 428/35.6 |
| 5,137,393 | 8/1992 | Fuhr et al. | 405/129 |
| 5,156,495 | 10/1992 | Mercer | 405/262 |
| 5,158,821 | 10/1992 | Gebauer et al. | 428/229 X |
| 5,167,765 | 12/1992 | Nielsen et al. | 162/146 |
| 5,187,004 | 2/1993 | Risseeuw | 428/229 |
| 5,191,777 | 3/1993 | Schnegg | 66/195 |
| 5,192,601 | 3/1993 | Neisler | 428/229 X |
| 5,219,636 | 6/1993 | Golz | 428/193 |
| 5,258,217 | 11/1993 | Lewis | 405/129 X |
| 5,403,126 | 4/1995 | Carriker et al. | 405/129 X |
| 5,419,951 | 5/1995 | Golz | 428/229 |

OTHER PUBLICATIONS

Strata Grid 500, Product Specifications (including product sample), Strata Systems, Inc., Alpharetta, Georgia.

Rehau–Armapal 5030 (including product sample).

Published Information: Fortrac, Matrex, Miragrid, Armapal, Raugrid and HaTelit, BTTG, Didsbury, Manchester, England.

Miragrid, Geogrides for Steep Slope Reinforcement, Nicolon Mirafi Group, Norcross, Georgia.

Geogrid Product Data, Geotechnical Fabrics Reports, Dec. 1992, pp. 171–178.

Product Data: Strata Grid, Strata Systems, Inc., Oct. 31, 1994.

"Pull Out Tests and Junction Strengths of Geogrids", Geosynthetics World, Jun. 1991.

Shacklette, L.W., et al, "EMI Shielding Intrinsically Conductive Polymers", ANTEC '91, pp. 665–667.

Kulkarni, V.G., et al, "Thermal Stability of Polyaniline", Synthetic Metals, 30 (1989), pp. 321–325.

Leidersdorf, C.B., et al, "The Sand Mattress Method of Slope Protection", Arctic Offshore Engineering, pp. 723–731.

Kulkarni, V.G., et al, "Processible Intrinsically Conductive Polymer Blends", ANTEC '91, pp. 663–664.

Nonwovens Markets, Jul. 22, 1996, p. 2.

BONDED COMPOSITE KNITTED STRUCTURAL TEXTILES

CROSS-REFERENCE TO RELATED APPLICATION

This application is a continuation-in-part of application Ser. No. 08/520,018, filed Aug. 28, 1995 now abandoned.

BACKGROUND OF THE INVENTION

1. Field of the Invention

The present invention relates to bonded composite knitted structural textiles primarily designed for use as structural load bearing elements in earthwork construction applications such as earth retention systems (in which the load bearing element is used to internally reinforce steeply inclined earth or construction fill materials to improve their structural stability), foundation improvement systems (in which the load bearing element is used to support and/or internally reinforce earth or foundation fill materials to improve their load bearing capacity), pavement improvement systems (in which the load bearing element is used to internally reinforce flexible pavements or to support rigid modular paving units to improve their structural performance and extend their useful service lives) or erosion protection systems (in which the load bearing element is used to confine or internally reinforce earth or construction fill materials in structures which are subject to erosion or which prevent erosion elsewhere by dissipating wave energy in open water). The textiles may be of either open mesh or conventional (closely knit) form. While the materials of this invention have many other diverse applications, they have been primarily designed to embody unique characteristics which are important in engineered earthwork construction and particular emphasis is placed on such uses throughout this application.

2. Description of the Prior Art

Geogrids and geotextiles are polymeric materials used as load bearing, separation or filtration elements in many earthwork construction applications. There are four general types of materials used in such applications: 1) integrally formed structural geogrids; 2) conventional woven or knitted textiles; 3) open mesh woven or knitted textiles; and 4) non-woven textiles. Geogrids and open mesh woven or knitted textiles are open mesh polymeric materials typically having at least 50% open area. Conventional geotextiles are materials typically having no more than 10% open area.

Integrally formed structural geogrids are formed by extruding a flat sheet of polymeric material, punching apertures in the sheet in a generally square or rectangular pattern and then uniaxially or biaxially stretching the apertured sheet, or by extruding an integrally formed mesh structure which constitutes a sheet with apertures in a generally square or rectangular pattern and then uniaxially or biaxially stretching the apertured sheet. Woven or knitted textiles are formed by mechanically interweaving or interlinking polymeric fibers or fiber bundles with conventional textile weaving or knitting technologies. Open mesh woven textiles are formed in this same manner and are normally coated in a subsequent process. Non-woven textiles are formed by overlaying and mechanically entangling polymeric fibers, generally by needling, and in some processes the entangled polymeric fibers are then re-oriented in a biaxial stretching process, calendared and/or heat fused.

Integrally formed structural geogrids are well known in the market and are an accepted embodiment in many earthwork construction applications. Open mesh woven or knitted textiles, generally characterized and marketed as textile geogrids, compete directly with integrally formed structural geogrids in many applications and have also established an accepted position in earthwork construction markets. Competition between either of these "geogrid" materials and conventional woven or knitted textiles is less frequent. Woven or knitted textiles with low basis weight tend to be used in separation and filtration applications. Woven or knitted textiles with high basis weight tend to be used in load bearing applications which are tolerant to the load-elongation properties of such materials and which can beneficially use the high ultimate tensile strength of such materials. Non-woven textiles are generally subject to very high elongation under load and are not normally used in load bearing earthwork construction applications. Competition between non-woven textiles and either of the "geogrid" materials or high basis weight woven or knitted textiles is negligible.

The characteristics of integrally formed structural geogrids and those of woven or knitted textiles, of either open mesh or conventional form, are significantly different in several respects. The integrally formed materials exhibit high structural integrity with high initial modulus, high junction strength and high flexural and torsional stiffness. Their rigid structure and substantial cross sectional profile also facilitate direct mechanical keying with construction fill materials, with contiguous sections of themselves when overlapped and embedded in construction fill materials and with rigid mechanical connectors such as bodkins, pins or hooks. These features of integrally formed structural geogrids provide excellent resistance to movement of particulate construction fill materials and the integrally formed load bearing elements relative to each other, thereby preserving the structural integrity of foundation fill materials or preventing pull out of the embedded load bearing elements in earth retention applications.

Integrally formed structural geogrids interact with soil or particulate construction fill materials by the process of the soil or construction fill materials penetrating the apertures of the rigid, integrally formed geogrid. The result is that the geogrid and the soil or construction fill materials act together to form a solid, continuously reinforced matrix. Both the longitudinal load bearing members and the transverse load bearing members and the continuity of strength between the longitudinal and the transverse load bearing members of the geogrid are essential in this continuous, matrix-like interlocking and reinforcing process. If the junction between the longitudinal and the transverse load bearing members fails, the geogrid ceases to function in this manner and the confinement and reinforcement effects are greatly reduced. Their rigid structure also facilitates their use over very weak or wet subgrades where placement of such load bearing materials and subsequent placement of construction fill materials is difficult.

Woven or knitted textiles, of either open mesh or conventional form, exhibit higher overall elongation under load, lower initial modulus, softer hand and greater flexibility. With sufficient increase in the number of fibers or fiber bundles comprising their structure they are capable of achieving higher ultimate tensile strength than is typically achieved with integrally formed structural geogrids. However, their lower initial modulus limits their effectiveness in structural earthwork applications in which deformation of the reinforced structure is undesirable or unacceptable. Woven or knitted textiles also exhibit low structural integrity which limits their effectiveness in direct mechanical keying with construction fill materials, with contiguous sections of themselves when embedded in construction fill materials or with rigid mechanical connectors. As a result, such materials are primarily used in applications which rely on a frictional interface with construction fill materials to transfer structural loads to the load bearing element and users of such materials also avoid applications which involve load bearing connections with rigid mechanical connectors. When load bearing connections are required in use of woven or knitted textiles, sewn seams are typically employed. Such seams typically exhibit only 50% of the textile strength of the unsewn textiles. Also, the low flexural and torsional stiffness of woven or knitted textiles limit their practical usefulness and performance in certain earthwork applications such as construction over very weak subgrades or construction fill reinforcement in foundation improvement applications.

The attributes which are most pertinent to the use of polymeric materials in structural load bearing earthwork construction applications are:

(a) the load transfer mechanism by which structural forces are transferred to the load bearing element, (b) the load capacity of the load bearing element;

(c) the structural integrity of the load bearing element when subjected to deforming forces in installation and use; and (d) the resistance of the load bearing element to degradation (i.e., loss of key properties) when subject to installation or long term environmental stress.

The limitations which woven or knitted textiles exhibit with respect to the first three attributes listed above primarily result from a lack of rigidity and tautness in the fibers or fiber bundles of these materials in which many separate fibers or fiber bundles are interlinked, interwoven, stitched or entangled in a manner which is characteristic of a woven or knitted structure and which does not cause the load bearing fibers or fiber bundles to be either taut or dimensionally stable relative to each other. The limitations which such materials exhibit with respect to the fourth attribute listed above primarily result from degradation of their coating materials and separation of such coating materials from the load bearing fibers or degradation of the primary polymeric material comprising the load bearing element by ultra violet or environmental attack.

Attempts have been made to dimensionally stabilize and protect the fibers or fiber bundles in the junction zones of open mesh woven or knitted textiles. For instance, such open mesh textiles are normally coated with another material such as polyvinylchloride after the principal textile structure is formed on a weaving or knitting loom. This technique improves the dimensional stability of the fibers or fiber bundles in the junction zone to some extent and also provides some protection from abrasion to the fibers throughout the textile. Other attempts also have been made to dimensionally stabilize and protect the fibers or fiber bundles in woven or knitted textiles. For instance, special constructions with flat warps and third yarn stitching systems have been produced to reduce elongation and stabilize the fiber bundles and the textile structure. This technique also improves the dimensional stability of the fiber bundles to some extent. However, neither of these techniques have delivered sufficient junction strength or sufficient initial modulus to enable such materials to be functionally comparable to integrally formed structural geogrids or to be directly competitive with integrally formed structural geogrids in certain demanding earthwork construction applications which require or benefit from load transfer by direct mechanical keying or high initial modulus or high structural integrity or stiffness in the load bearing element. The protective coatings also tend to degrade and separate from the load bearing fibers, thereby reducing their effectiveness in providing long term resistance to environmental degradation of the load bearing fibers and also creating a potential shear failure surface at the interface between the load bearing fibers and the coating material.

SUMMARY OF THE INVENTION

It is an object of the present invention to provide a knitted textile of either open mesh or conventional form which has improved suitability for use as a structural load bearing element in demanding earthwork construction applications.

It is another object of the present invention to provide a knitted textile with improvements over the prior art in one or more of the following attributes:

(a) its load transfer mechanism (specifically its suitability in its open mesh form for direct mechanical keying with construction fill materials, with contiguous sections of itself when overlapped and embedded in construction fill materials and with rigid mechanical connectors such as bodkins, pins or hooks, and in its conventional form its frictional interface with construction fill materials);

(b) its load capacity (specifically its initial modulus, i.e., its resistance to elongation when initially subject to load);

(c) its structural integrity (specifically its junction strength and its flexural and torsional stiffness in its open mesh form, and the tautness and dimensional stability of its load bearing fibers relative to each other as well as its overall flexural and torsional stiffness in its conventional form); and (d) its durability (specifically its resistance to degradation when subject to installation and long term environmental stress).

These and other objects of the present invention will become apparent with reference to the following specification and claims.

Bonded composite knitted structural textiles according to the present invention are knitted textiles formed from at least two and preferably three independent but complementary polymeric components. The first component, the load bearing element, is a high tenacity, high initial modulus, low elongation monofilament or multifilament polymeric fiber or bundle of such fibers with each fiber being of homogenous or bicomponent structure. Where bicomponent fibers or fiber bundles are used to form such load bearing elements it is possible to achieve improved resistance to degradation (i.e., loss of key properties) when such materials are subject to installation and long term environmental stress in use (i.e., by using a core material most suited to achievement of desired mechanical properties and a different sheath material most suited to achievement of desired durability properties in a particular field of use). The second component, a bonding element, is an independent polymeric material in monofilament or multifilament form and of homogenous or bicomponent structure which is used to encapsulate and/or bond the load bearing fibers thereby stiffening the composite material, increasing its resistance to elongation under load and increasing its resistance to degradation when subject to installation or long term environmental stress. The third component, when used, is an effect or bulking fiber which increases the cross section of the bonded composite knitted structural textile thereby further increasing its stiffness and increasing its effectiveness in mechanically interlocking (keying) and/or frictionally interfacing with particulate construction fill materials.

In the bonded composite knitted structural textile a plurality of laid-in warp and/or weft fibers (commonly referred to as yarns) are knitted together with one or more ground yarns. At least a portion of the laid-in warp and/or weft yarns are first component load bearing yarns. The second polymer component is used as required for the bonding properties necessary for the finished product, and especially to provide improved junction strength in the open mesh form or improved tautness and dimensional stability of load bearing fibers relative to each other in the conventional form. The effect or bulking yarns are used as warp and/or weft yarns and/or knitting yarns. The effect or bulking yarns also increase friction with adjacent yarns to provide better stability and structural integrity in the overall material. Two or more effect or bulking yarns intersecting one another provide the greatest stability. The effect or bulking yarns also provide the desired bulk in the textile and relatively thick cross sectional profile for the finished product to improve its stiffness and its effectiveness in mechanically interlocking with particulate construction fill material in the open mesh form or in frictionally interfacing with conventional fill materials in the conventional form.

The second component may be incorporated into the textile in several ways. The second component may be provided by a fusible bonding yarn, either monofilament or multifilament, which is preferably a bicomponent yarn having a low melting temperature sheath and a high melting temperature core. In the knitted textile, the fusible bonding yarns may be used as warp and/or weft yarns and/or knitting yarns to provide the improved junction strength in the open mesh form or improved tautness and dimensional stability of the load bearing fibers relative to each other and improved flexural and torsional stiffness in the conventional form. The fusible bonding yarns may also be used in non-woven textiles incorporated into the knitted structure. Alternatively, the second component may be provided by a suitable polymer applied and bonded to the textile by any of a number of different processes after the textile leaves the knitting machine. The second component also may be provided by a combination of a fusible bonding yarn and an additional polymeric material independently applied and bonded to the textile.

In accordance with one embodiment of the invention where a fusible bonding yarn is used, the knitted textile is heated to melt the fusible polymer component, i.e., to melt the monofilament and/or multifilament bonding fibers or the sheath of the bicomponent bonding fibers. This causes the fusible polymer component to flow around and encapsulate the other components of the textile and protects, strengthens and stiffens the overall structure, and particularly the junctions in the open mesh form. In accordance with another embodiment of the invention, the knitted textile is impregnated with a suitable polymer which flows around and encapsulates the other components of the textile, especially the junctions in the open mesh form. The impregnated textile is then heated to dry and/or cure the polymer to bond the yarns which protects, strengthens and stiffens the overall structure, especially the junctions in the open mesh form. In accordance with yet another embodiment of the invention, a polymer sheet or web is applied to the knitted textile and heated to melt the sheet or web causing the polymer to flow around and encapsulate the yarn components of the textile and protect, strengthen and stiffen the overall structure.

The materials produced according to the present invention can also be modified for various applications by selection of the type and number and location of the first component load bearing yarns and the type and number and location of the second component fusible bonding yarns and/or other independent polymeric bonding materials, and the type and location of the optional third component bulking yarns. Thus, the material can be custom tailored for particular applications. Materials produced according to the present invention can also easily be designed and manufactured to achieve specific tensile properties in the longitudinal direction or both the longitudinal and transverse directions. This flexibility enables more efficient use of the instant invention in demanding earthwork applications which often have widely varying and site specific needs. The use of fusible yarns and/or other polymeric bonding materials to strengthen the junctions in the open mesh form and increase overall material stiffness and initial modulus also permits increased flexibility in the design of civil engineering structures and commercial use of such materials. Inexpensive bulking yarns may also be used in a variety of economical ways to provide bulk and increased cross sectional profile without sacrificing strength or other desirable characteristics. For example, some or all warp or weft yarn bundles may be selected to provide a thick profile through the addition of bulking yarns or additional strength yarns. The resulting thick profile, either in all yarn bundles or in certain selected yarn bundles, for example every sixth weft yarn bundle, will provide improved frictional interface with construction fill materials (i.e., resistance to pullout). The thick yarn bundle profile in the open mesh form of the bonded composite knitted structural textile functions in a manner similar to the vertical cross sectional faces of an integrally formed structural geogrid. The thick yarn bundle profile in the conventional form of the bonded composite knitted structural textile functions in an analogous manner by presenting an irregular but rigid frictional interface with construction fill materials. Finally, materials produced according to the present invention can be manufactured using conventional, inexpensive, widely available knitting equipment which minimizes the cost of production of such materials.

Materials produced according to the present invention have a number of advantages compared to woven or knitted textiles, of either open mesh or conventional form, the collective effect of which is to render materials produced according to the present invention much more suitable for use in demanding earthwork construction applications. The primary benefits of the inventive concepts embodied in materials produced according to the present invention are described below:

| Feature | Benefit |
|---|---|
| 1. Improved structural integrity (dimensional stability of load bearing fibers relative to each other) | causes structural forces in demanding earthwork construction applications to be transferred to the load bearing elements of the instant invention by means of positive mechanical interlock with construction fill materials and/or by increased frictional interface with such construction fill materials; also enables use of the open mesh form of the instant invention in applications requiring or |

-continued

| Feature | Benefit |
|---|---|
| | favoring use of rigid mechanical connectors such as bodkins, pins or hooks in the case of open mesh textiles |
| 2. Improved cross sectional profile | causes load bearing elements transversely oriented relative to structural forces in demanding earthwork construction applications to present an increased abutment and/or frictional interface to particulate contruction fill materials, thereby substantially increasing their resistance to movement relative to such particulate construction fill materials (commonly called pull out resistance) |
| 3. Improved initial modulus | causes structural forces in demanding earthwork applications to be transferred to the load bearing elements of the instant invention at very low strain levels, thereby substantially reducing deformation in the earthwork structure and substantially increasing the efficiency of use of such load bearing elements in demanding earthwork construction applications |
| 4. Improved flexural stiffness | causes the matrix of transversely oriented load bearing elements in the instant invention to resist in plane deflection, thereby increasing its ease of installation, particularly over very weak or wet subgrades and increasing its capacity to support construction fill materials initially placed on top of such subgrades |
| 5. Improved torsional stiffness | causes the matrix of transversely oriented load bearing elements in the instant invention to resist in plane or rotational movement of particulate construction fill materials when subject to dynamic loads such as a moving vehicle causes in an aggregate foundation for a roadway thereby increasing the load bearing capacity of the particulate construction fill materials and increasing the efficiency of use of such load bearing elements in such demanding earthwork construction applications |
| 6. Improved resistance to degradation | causes the instant invention to have improved suitability for use in earthwork construction applications which involve exposure to significant mechanical stress in installation or use and/or involve exposure to significant long term environmental (i.e., biological or chemical) stress in use |
| 7. Improved flexibility in product design and manufacture | enables widely disparate and complementary properties to be embodied in the instant invention via the independent polymeric materials chosen for use in each of the three components of the instant invention (the load bearing element, the bonding element and the bulking element) or chosen for use in the independent polymeric materials comprising the core or sheath components of any of these three elements and also enables the type and number and location of all such components of the instant invention to be economically varied without substantial modification of manufacturing equipment |
| 8. Improved efficiency in product use | enables users of the instant invention to exploit the various product features and the flexibility in choosing and using variants of such features all as described above to achieve performance and productivity gains in a wide variety of earthwork construction applications |
| 9. Improved suitability for use in demanding earth-work construction | causes the instant invention, by virtue of the collective features and benefits described above, to have greater opportunity for use in markets involving demanding earthwork construction applications than has heretofore been enjoyed by woven or knitted textiles in either open mesh or conventional form |

DETAILED DESCRIPTION OF THE DRAWINGS

Figure 1:
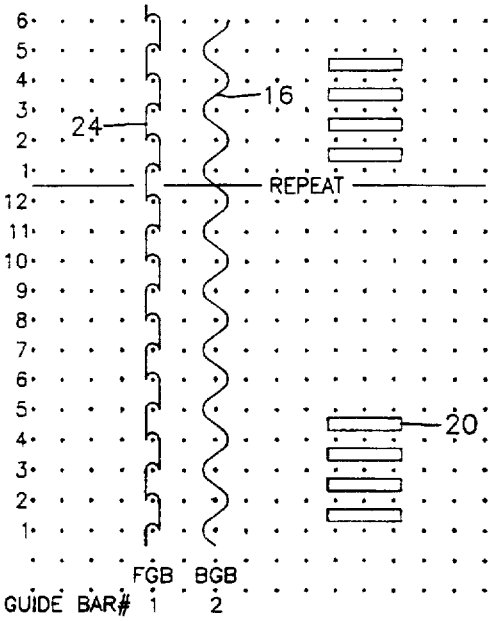
FIG. 1 is a lapping diagram with point paper notations (the needle heads being represented as dots) of a portion of a bonded composite knitted structural textile in open mesh form according to the present invention.
Figure 2:
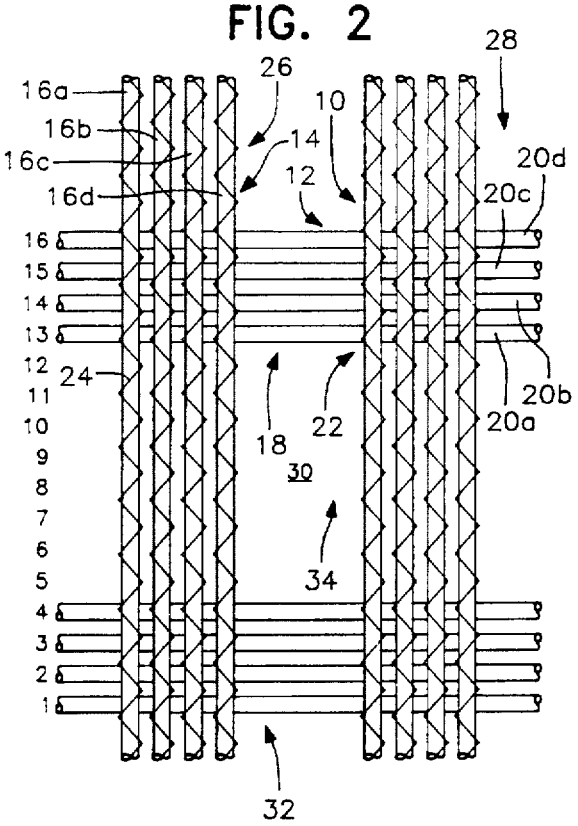
FIG. 2 is an exploded schematic plan view of the technical back of a portion of the bonded composite knitted structural textile in open mesh form of FIG. 1.
Figure 3:
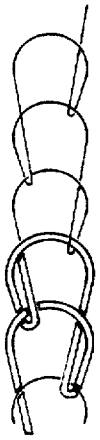
FIG. 3 is an exploded schematic plan view of the knitting yarn of FIGS. 1 and 2 showing one wale of the open chain stitch.

Referring to FIGS. 1—3, the bidirectional weft inserted warp knit textile 10 is formed into an openwork apertured structure or open mesh textile 12 of the present invention. Textile 10 is formed of a plurality of spaced apart warp yarn bundles 14. Each warp yarn bundle is formed of a plurality of laid-in warp yarns 16 (16*a–d*). Each bundle 14 of warp yarns 16 includes edge warp yarns 16*a* and 16*d*. The warp yarn bundles 14 are knitted together with a plurality of spaced apart weft yarn bundles 18. Each of the weft yarn bundles 18 is formed of a plurality of laid-in weft or filling yarns 20 (20*a–d*). Each bundle 18 of weft yarns 20 includes edge weft yarns 20*a* and 20*d*. At the junctions or joints 22 of the open mesh textile 12, the warp yarns 16 overlap the weft yarns 20. The warp yarns 16 and weft yarns 20 are joined at junctions 22 by knitting yarns 24.

The knitting yarns 24 comprise an open chain stitch (1–0/0–1//), one wale of which is illustrated in FIG. 3 with the warp yarns 16 and weft yarns 20 being omitted. The width repeat of the open chain stitch is one stitch and the height repeat is two stitches. Referring to FIG. 1, it should be understood that the timing of the front guide bar ("FGB") associated with the knitting yarns 24 relative to the back guide bar ("BGB") associated with the warp yarns 16 illustrated in FIG. 1 may be advanced or delayed by one course compared to the arrangement as illustrated. The knitting yarns 24 are the locking members (yarns) which secure the warp and weft yarns 16 and 20, respectively, together. The denier or strength of the knitting yarns 24 is thus directly related to the delamination strength between the warp and weft yarn layers.

The knitted textile of the present invention may be formed on any conventional weft insertion warp knitting machine such as a machine produced by Liba, Mayer, Malimo or Barfuss. As illustrated in FIGS. 1 and 2, each warp yarn bundle 14 has four warp yarns 16*a–d* and each weft yarn bundle 18 has four weft yarns 20*a–d*. The knitting machine will typically insert eight empty wefts for a complete cycle of twelve courses. The maximum total courses per inch will typically be about 12 to 36. The number of warp ends per inch will typically be about 6 to 18.

The open mesh textile 12 has lateral or cross-machine members 28 (weft yarn bundles 18) and longitudinal or machine direction members 26 (warp yarn bundles 14) which interconnect at the junctions 22 to define relatively large openings 30 through which soil, water or other material may pass when the open mesh textile 12 is placed in the earth. The openings 30 will typically be about ¾ to 1 inch. While openings 30 are illustrated as square, the openings may be rectangular. If desired, the openings 30 may be up to 12 inches or more in the warp direction. There could be as few as 6 to 10 weft yarns (in one cross member) per 12 inches of warp which would produce an unbalanced structure analogous to a uniaxially oriented integrally formed structural geogrid. The shape and size of the openings 30 will depend on the performance requirements of the open mesh textile; however, the shape and size of the openings can be selected by adjusting the relative positioning of the warp yarn bundles 14 and the weft yarn bundles 18. Open mesh textile 12 has a first side 32 and second side 34.

Figure 4:
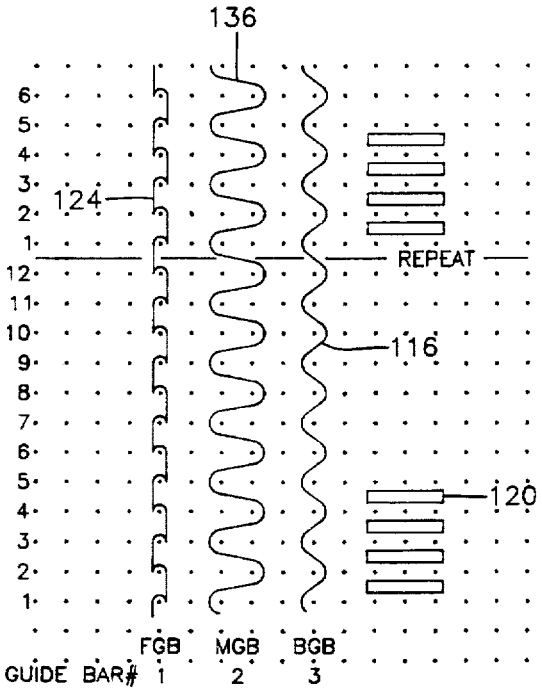
FIG. 4 is a lapping diagram with point paper notations of a portion of a bonded composite knitted structural textile in open mesh form according to the invention showing another knitted pattern.
Figure 5:
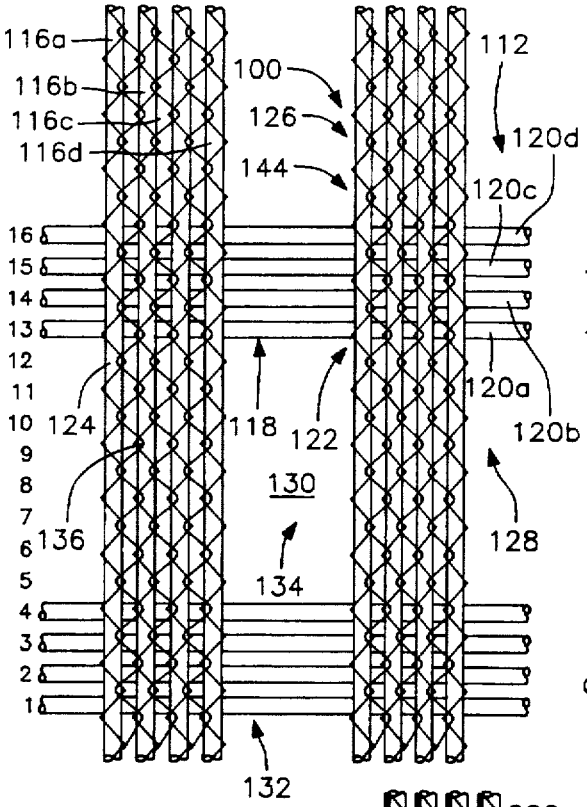
FIG. 5 is an exploded schematic plan view of the technical back of a portion of the bonded composite knitted structural textile in open mesh form of FIG. 4.

FIGS. 4–13 show additional knitted textile constructions according to the present invention in which the same reference numerals are used as in FIGS. 1–3 for the same components or elements except in the "100", "200", "300", "400" and "500" series, respectively. More specifically, FIGS. 4 and 5 show a knitted textile construction 100 which is similar to knitted textile 10 of FIGS. 1–3 except textile 100 also includes additional laid-in warp yarns 136 which are laid-in by the middle guide bar ("MGB"). The knitting yarns 124 are again associated with the front guide bar and, in this embodiment, the warp yarns 116 are laid-in by the back guide bar ("BGB"). The warp yarns 136 are laid-in over two needles and through the open chain stitches of adjacent knitting yarns 124. Each of the warp yarns 136 pulls adjacent warp yarns 116 (e.g., 116*a* and 116*b*) tightly together. The three warp yarns 136 associated with each warp yarn bundle 114 together act to form tight bundles 114 of warp yarns 116. This maximizes the openings 130. It should be understood that the warp yarns 136 could be laid-in over four needles in which case only one warp yarn 136 would be required to tightly bind a warp yarn bundle 114 together.

Figure 6:
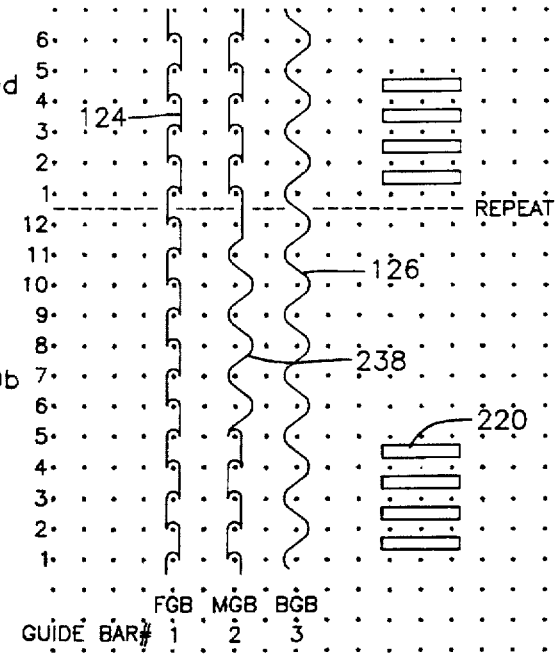
FIG. 6 is a lapping diagram with point paper notations of a portion of a bonded composite knitted structural textile in open mesh form according to the invention showing yet another knitted pattern.
Figure 7:
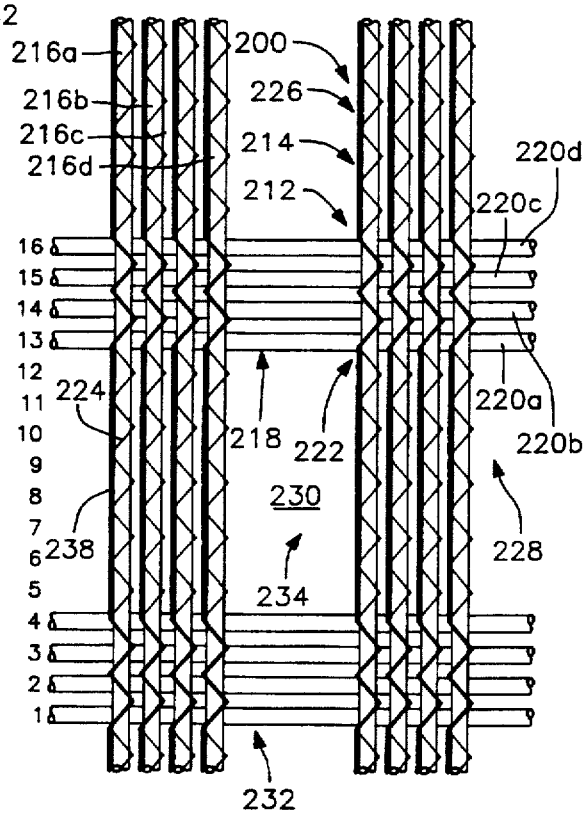
FIG. 7 is an exploded schematic plan view of the technical back of a portion of the bonded composite knitted structural textile of FIG. 6.

FIGS. 6 and 7 show another knitted textile construction 200. In this construction, secondary knitting yarns 238 are associated with the middle guide bar. The primary knitting yarns 224 are again associated with the front guide bar and, in this embodiment, the warp yarns 216 (load bearing members in the machine direction) are laid-in by the back guide bar. The primary knitting yarns 224 and the secondary knitting yarns 238 are formed with a lapping movement in opposition at each course at each of junctions 222. Thus, secondary knitting yarns 238 form an open chain stitch (0–1/1–0//) at junctions 222, but are simply laid-in parallel to warp yarns 216 between junctions 222 (i.e., at courses 5–12). The secondary knitting yarns 238 may be heavy denier yarns for improved resistance to warp/fill delamination.

Figure 8:
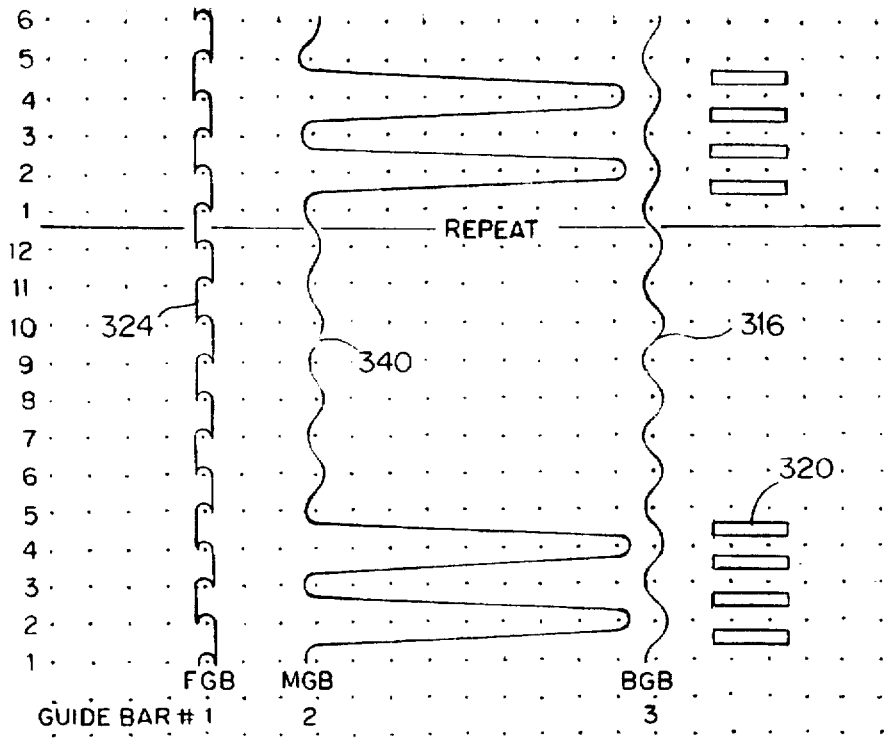
FIG. 8 is a lapping diagram with point paper notations of a portion of a bonded composite knitted structural textile in open mesh form according to the invention showing a further knitted pattern.
Figure 9:
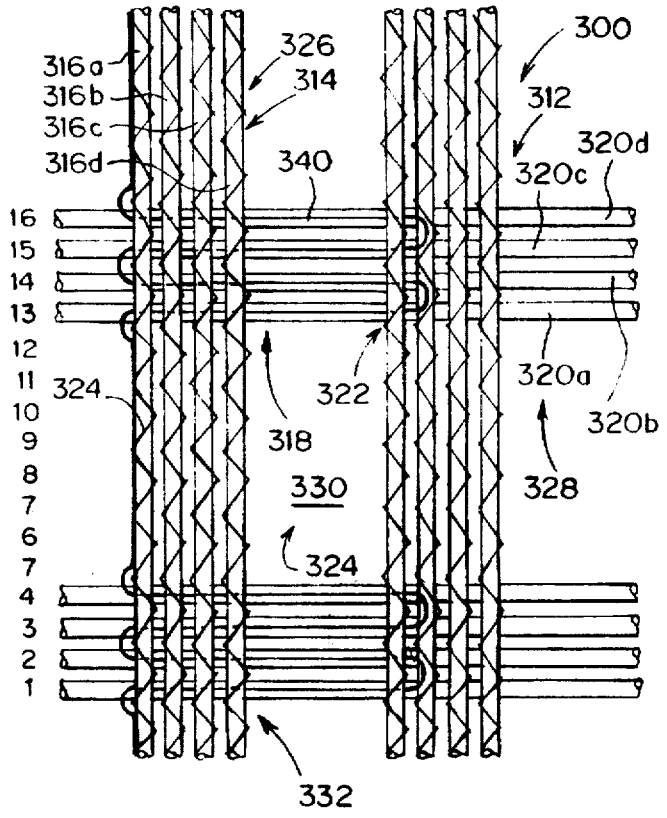
FIG. 9 is an exploded schematic plan view of the technical back of a portion of the bonded composite knitted structural textile of FIG. 8.

FIGS. 8 and 9 show a textile construction 300 which includes additional laid-in warp yarns 340 which are laid-in by the middle guide bar. The knitting yarns 324 are again associated with the front guide bar and, in this embodiment, the warp yarns 316 are laid-in by the back guide bar. The warp yarns 340 are laid-in over nine needles at junctions 322 to tie adjacent warp yarn bundles 314 together and to provide high resistance to warp yarns 316 shifting (side to side). It should be understood, however, that warp yarns 340 could be laid-in over ten, eleven or twelve needles at junctions 322 to meet the structural needs of the textile. As will be clear from the illustration, warp yarns 340 are simply laid-in between junctions 222 (i.e., at courses 5–12) parallel to warp yarns 316.

Figure 10:
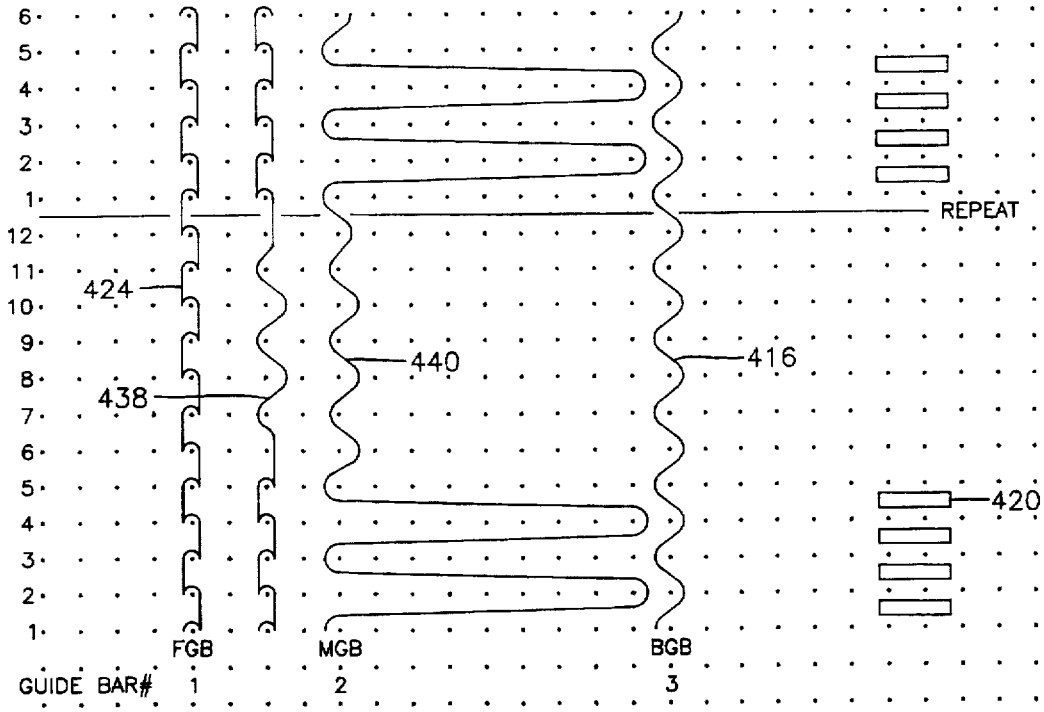
FIG. 10 is a lapping diagram with point paper notations of a portion of a bonded composite knitted structural textile of open mesh form according to the invention showing yet a further knitted pattern.
Figure 11:
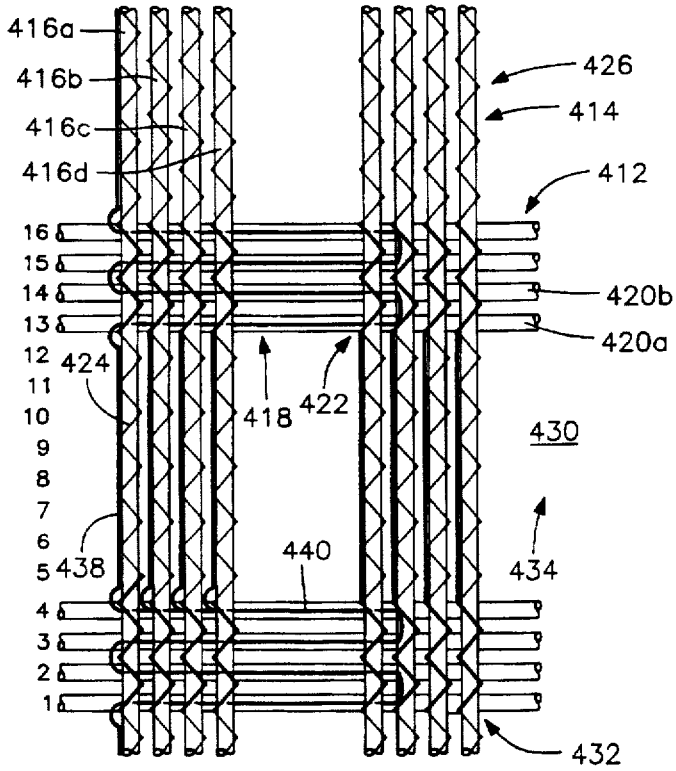
FIG. 11 is an exploded schematic plan view of the technical back of a portion of the bonded composite knitted structural textile of FIG. 10.

FIGS. 10 and 11 show a textile construction 400 that combines the features of the embodiment illustrated in FIGS. 6 and 7 with the embodiment illustrated in FIGS. 8 and 9. More specifically, this textile construction uses a secondary knitting yarn 438 as in FIGS. 6 and 7 (reference number 238) and additional laid-in warp yarns 440 as in FIGS. 8 and 9 (reference number 340). The guide bar timing for the guide bar associated with the laid-in warp yarns 440 could be advanced or delayed by one course to provide the same desired effect. Also, laying in the laid-in warp yarns 440 over ten, eleven or twelve needles at junctions 422 could be used.

Figure 12:
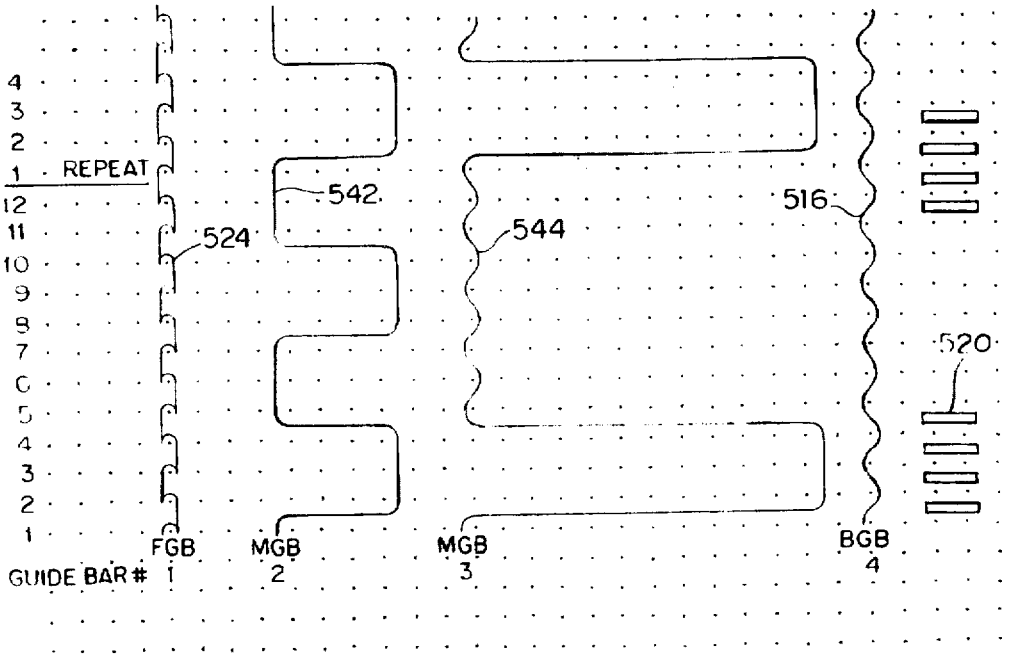
FIG. 12 is a lapping diagram with point paper notations of a portion of a bonded composite knitted structural textile in open mesh form according to the invention showing still a further knitted pattern.
Figure 13:
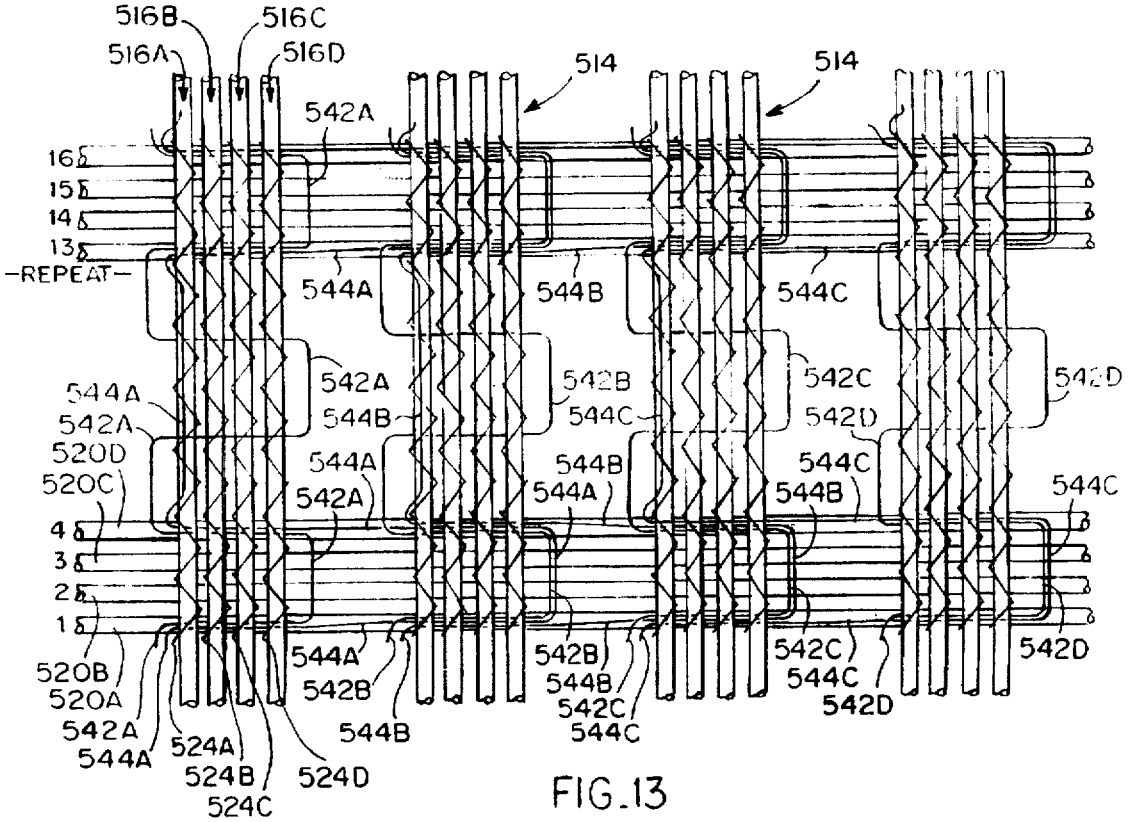
FIG. 13 is an exploded schematic plan view of the technical back of a portion of the bonded composite knitted structural textile of FIG. 12.

FIGS. 12 and 13 show a textile construction 500 that includes additional laid-in warp yarns 542 and 544. Warp yarns 542 (e.g., 542A, 542B and 542C) laid-in by the first middle guide bar (guide bar 2) draw the individual warp yarn bundles 514 together, and warp yarns 544 (e.g., 544A, 544B and 544C) laid-in by the second middle guide bar (guide bar 3) tie adjacent warp yarn bundles 514 together.

FIGS. 2, 5, 7, 9, 11 and 13 are exploded schematic plan views. However, it should be understood that the junctions 22, 122, 222, 322, 422 and 522 in FIGS. 2, 5, 7, 9, 11 and 13, respectively, are tightly knitted together in actual practice.

Figure 14:
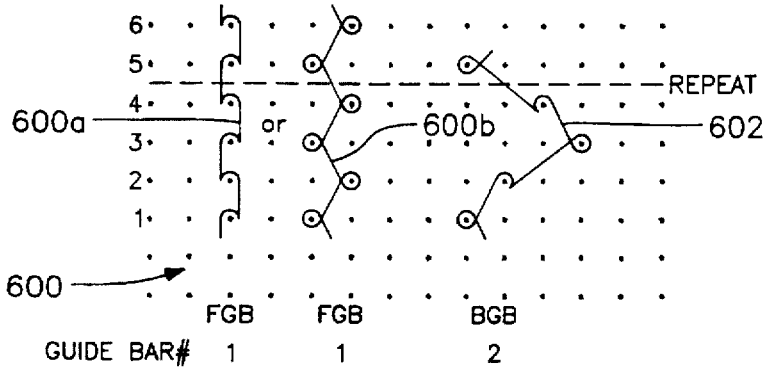
FIG. 14 is a lapping diagram with point paper notations of lapping patterns suitable for use in a non-run ground structure of a bonded composite knitted structural textile according to the invention.
Figure 15:
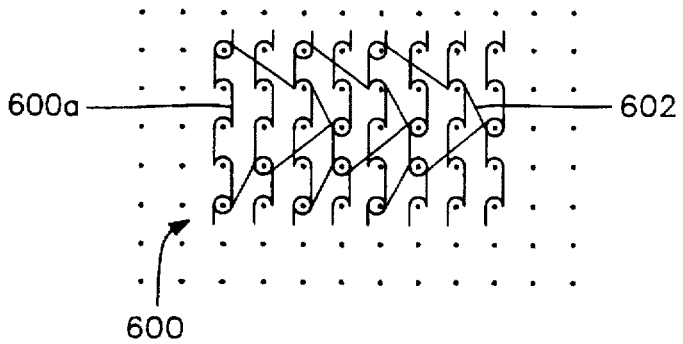
FIG. 15 is a lapping diagram with point paper notations integrating the lapping patterns of FIG. 14.

Referring to FIGS. 14 and 15, these figures illustrate the ground structure for a warp knit textile which is intended to have laid-in weft and/or warp yarns. Knitting yarns 600 associated with the FGB are fully threaded and comprise either an open chain stitch (1–0/0–1//) 600*a* or a tricot stitch (1–0/1–2//) 600*b*, with the chain stitch 600*a* being illustrated in FIG. 15. Knitting yarns 602 are associated with the BGB and are threaded 1 in and 1 out (3–4/3–2/1–0/1–2//). This type ground structure with two consecutive stitches in a wale being formed by one guide bar (1 yarn/stitch) and the next two consecutive stitches being formed by two guide bars (2 yarns/stitch) makes it more difficult to intentionally or unintentionally cause a warp knit textile to run or to ravel.

Figure 16:
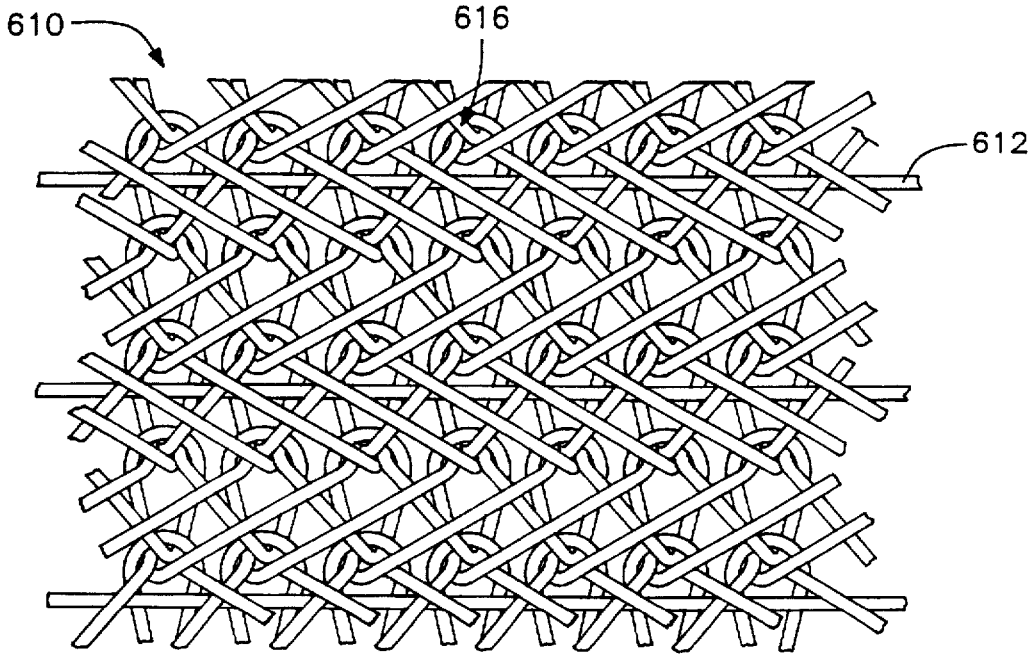
FIG. 16 is an exploded schematic plan view of the technical back of a portion of a bonded composite knitted structural textile showing another knitted pattern.

FIG. 16 shows a weft inserted warp knit textile 610 made using two knitting guide bars and laid-in weft yarns 612 on alternate courses. The knitting yarns 614 are associated with the FGB (1–0/2–3//) and the knitting yarns 616 are associated with the BGB (1–2/1–0//). This is a dimensionally stable textile in the weft (cross-machine direction) due to the high tenacity, low elongation, heavy denier weft yarns 612.

Figure 17:
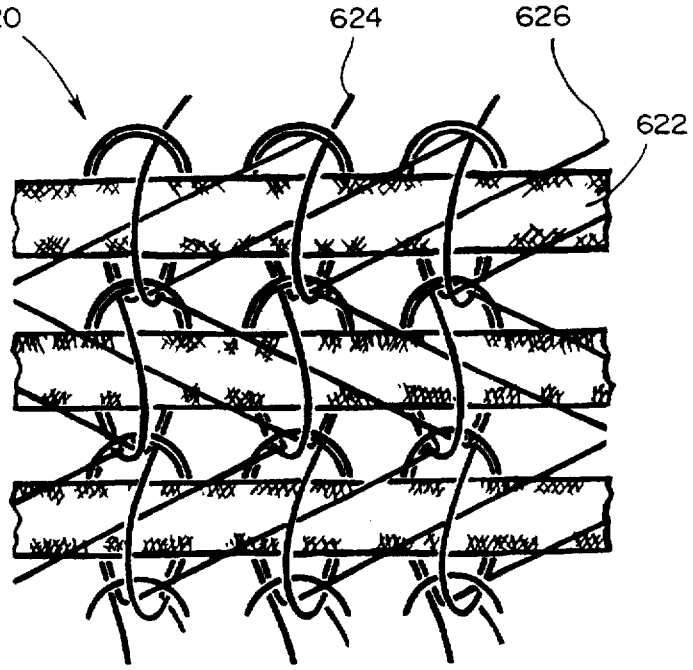
FIG. 17 is an exploded schematic plan view of the technical back of a portion of a bonded composite knitted structural textile showing another knitted pattern.

FIG. 17 shows another weft inserted warp knit textile 620 having horizontal/widthwise reinforcement only and no vertical/lengthwise reinforcement. The weft yarns 622 are laid-in at every course. The knitting yarns 624 are associated with the FGB (1–0/0–1//) and the knitting yarns 626 are associated with the BGB (2–3/1–0//).

Figure 18:
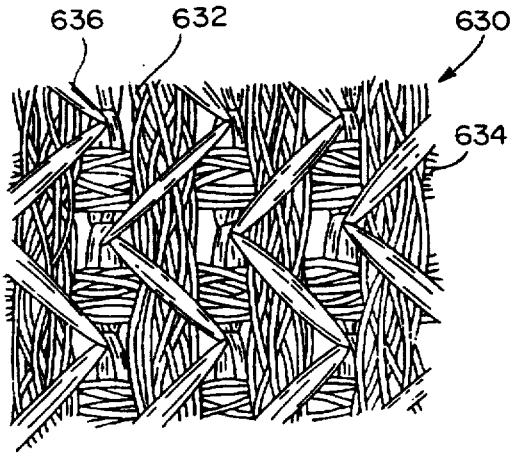
FIG. 18 is an exploded schematic plan view of the technical back of a portion of a bonded composite knitted structural textile showing another knitted pattern.
Figure 19:
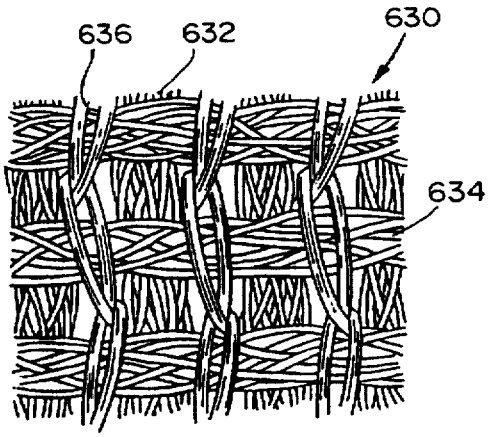
FIG. 19 is an exploded schematic plan view of the technical face of the portion of the bonded composite knitted structural textile of FIG. 18.

Referring to FIGS. 18 and 19, the weft inserted warp knit textile 630 includes straight laid-in warp yarns 632 (BGB=0–0//) and laid-in weft yarns 634 at every course providing biaxial reinforcement with no crimp in the load bearing yarns. The two load bearing yarn systems each lie in their own plane with no locking-in between the two yarns. The third yarn system, the knitting/stitch forming yarns 636 (FGB=1–0/1–2//), surrounds the two laid-in yarn systems and keeps them in a uniform structure.

Figure 20:
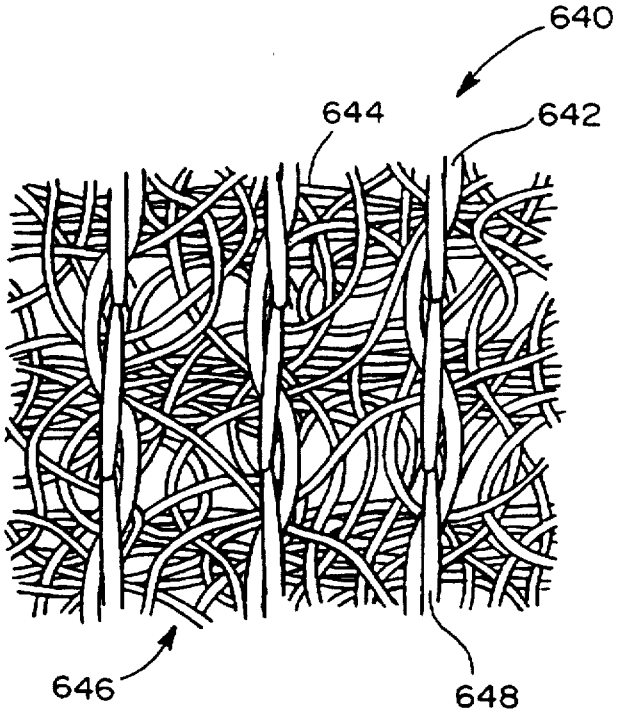
FIG. 20 is an exploded schematic plan view of the technical back of a portion of a bonded composite knitted structural textile showing a knitted pattern which includes a non-woven web.
Figure 21:
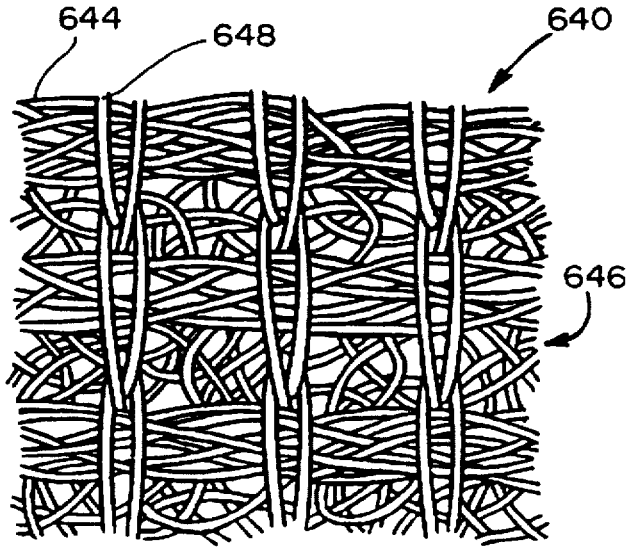
FIG. 21 is an exploded schematic plan view of the technical face of the portion of the bonded composite knitted structural textile of FIG. 20 wherein the laid-in warp yarns are not visible.

FIGS. 20 and 21 show a weft inserted warp knit textile 640 with laid-in warp yarns 642 (BGB=0–0/1–1//) and laid-in weft yarns 644 at every course. A non-woven filtration textile 646 is laid-in between the warp yarns 642 and the weft yarns 644. The knitting yarns 648 are associated with the FGB and comprise a chain stitch (1–0/0–1//).

Figure 22:
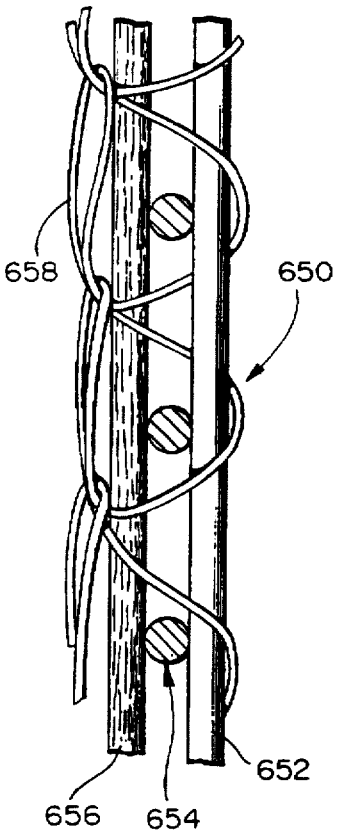
FIG. 22 is an exploded schematic sectional view of a portion of a bonded composite knitted structural textile showing another knitted pattern which includes a non-woven web.

FIG. 22 shows a weft inserted warp knit textile 650 with laid-in warp yarns 652 (BGB=0–0/1–1// as shown or 1–1/0–0//) and laid-in weft yarns 654 at every course. A non-woven filtration textile 656 is laid-in under the weft yarns 654. The knitting yarns 658 are associated with the FGB (1–0/0–1//).

Figure 23:
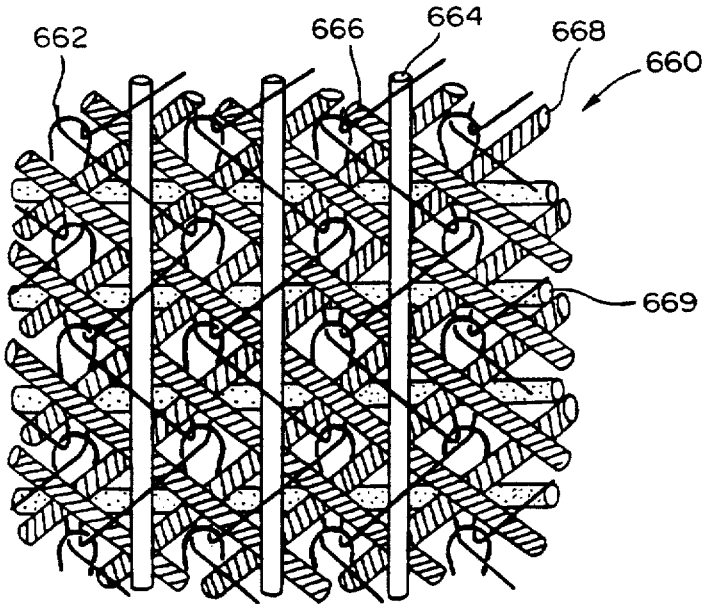
FIG. 23 is an exploded schematic plan view of the technical back of a portion of a bonded composite knitted structural textile showing yet another knitted pattern.

Referring to FIG. 23, the quadriaxial multiaxis bias weft inserted warp knit textile 660 has the following layers from the technical back: knitting yarns 662 associated with the FGB (0–1/2–1//), laid-in warp yarns 664 (0°) associated with the BGB (0–0/0–0//), laid-in bias weft yarns 666 (−45°) at every course, laid-in bias weft yarns 668 (+45°) at every course, laid-in horizontal weft yarns 669 (90°) at every course, and knitting yarns 662.

Figure 24:
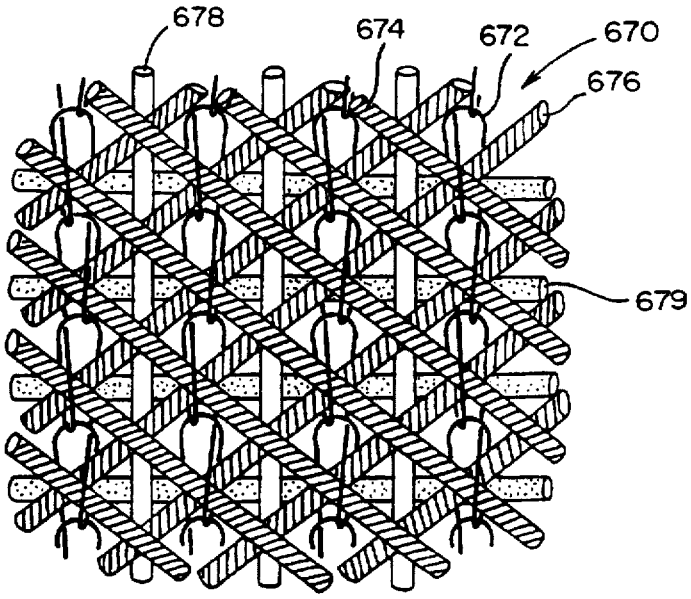
FIG. 24 is an exploded schematic plan view of the technical back of a portion of a bonded composite knitted structural textile showing yet another knitted pattern.

FIG. 24 shows another quadriaxial multiaxis bias weft inserted warp knit textile 670 having the following layers from the technical back: knitting yarns 672 associated with the FGB (1–0/0–1//), laid-in bias weft yarns 674 (–45°) at every course and needle, laid-in bias weft yarns 676 (+45°) at every course and needle, laid-in warp yarns 678 (0°) at every needle space, laid-in weft yarns 679 (90°) at every course, and knitting yarns 672.

Referring to FIGS. 18–24, these textile could be improved by adding a second knitting yarn resulting in a more run/ravel resistant textile. The second knitting yarn would be threaded 1 in 1 out. The stitches in each wale should be formed in a patterned arrangement with some stitches being formed by one yarn or guide bar and other stitches being formed by two yarns or guide bars. Preferably, the guide bars for the ground structure will have different lapping movements. It is also preferred that the underlaps of the second knitting yarn have varying lengths and/or that the second knitting yarn forms a combination of closed lap and open lap stitches. An example of a typical knitting construction of this type is illustrated in FIGS. 14 and 15. Referring to FIGS. 16 and 17, these textiles could be improved by adding a third knitting yarn having the characteristics of the second knitting yarn as described.

A majority of the laid-in weft and/or warp yarns are preferably the load bearing members, namely, the high tenacity, low modulus, low elongation mono- or multifilament yarns. Suitable mono- or multifilament yarns are formed from polyester, poly-vinylalcohol, nylon, aramid, fiberglass, and polyethylene naphthalate. The yarn fibers may be of homogeneous or bicomponent structure.

The load bearing member should have a strength of at least about 5 grams per denier, and preferably at least about 9 to 10 grams per denier. The initial Young's modulus of the load bearing member should be about 100 grams/denier, preferably about 150 to 400 grams/denier. The elongation of the load bearing member should be less than about 18%, preferably less than about 10%. The load bearing member will typically have a denier of about 1,000 to 2,000, preferably about 2,000 to 18,000.

The textiles can be produced with approximately equal strength and/or frictional characteristics in the longitudinal or machine direction and in the lateral or cross-machine direction. Alternatively, the textiles can be produced with greater strength and/or frictional characteristics in either the longitudinal direction or the lateral direction. The selection of the strength characteristics of the textiles will be determined based on the requirements of the application design.

The fusible bonding yarns, if incorporated into the knitted structure, are used as laid-in warp and/or weft yarns and/or knitting yarns as required for the desired bonding properties, and especially the bonding properties needed to form the necessary strength of the textiles. When the textile is heated to melt the fusible polymer component, the fusible polymer component flows around and encapsulates other components of the textile bonding and stabilizing the textile structure and protecting the load bearing yarns from abrasion and chemical attack. The fusible yarns will lock the textile into a stable structure unaffected by yarn shifting when the hydrostatic pressure increases on the textile in use. Also, fusible yarns will further enhance and secure the stability of the knitted structure by locking the yarns into a fixed position so that subsequent handling and soil dynamics under high pressure situations do not move the yarn/knit geometry in situ and substantially modify the characteristics of the textile as produced. The fusible yarn may be a monofilament or multifilament form of yarn and of homogeneous or bicomponent composition.

The preferred fusible bonding yarn is a bicomponent yarn such as one having a low melting sheath of polyethylene, polyisophthalic acid or the like, and a high melting core of polyester, polyvinylalcohol or the like. The bicomponent yarn also may be a side-by-side yarn in which two different components (one low melting and one high melting) are fused along the axis and having an asymmetrical cross-section, or a biconstituent yarn having one component dispersed in a matrix of the other component, the two components having different melting points. The low and high melting components also may be polyethylene and polypropylene, respectively, different melting point polyesters, or polyamide and polyester, respectively. The bicomponent yarn will typically be composed of 30 to 70% by weight of the low melting component, and 70 to 30% by weight of the high melting component. The fusible yarn also may be an extrusion coated yarn having a low melting coating or a low melting point yarn (e.g., polyethylene) employed in the textile structure side-by-side with other yarns.

As an alternative to using fusible bonding yarns, or in addition to using fusible bonding yarns, the textile is impregnated with a suitable polymer after it leaves the knitting machine. The textile may be passed through a polymer bath or sprayed with a polymer. The impregnating material typically comprises an aqueous dispersion of the polymer. In the impregnation process, the polymer flows around and encapsulates other components of the textile. The impregnated textile is then heated to dry and/or cure the polymer to bond the yarns.

The polymer may be a urethane, acrylic, vinyl, rubber or other suitable polymer which will form a bond with the yarns used in the textile. The urethane polymer may be, for example, an aqueous dispersible aliphatic polyurethane, such as a polycarbonate polyurethane, which may be crosslinked to optimize its film properties, such as with an aziridine crosslinker. Suitable urethane polymers and crosslinkers are available commercially from Stahl U.S.A., Peabody, Mass. (e.g., UE-41-503 aqueous polyurethane and KM-10-1703 aziridine crosslinker) and Sanncore Industries, Inc., Leominster, Mass. (e.g., SANCURE® 815 and 2720 polyurethane dispersions). The acrylic polymer may be, for example, a heat reactive acrylic copolymer latex, such as a heat reactive, carboxylated acrylic copolymer latex. Suitable acrylic latexes are available from B. F. Goodrich, Cleveland, Ohio (e.g., HYCAR® 26138 latex, HYCAR® 26091 latex and HYCAR® 26171 latex). The vinyl polymer may be a polyvinylchloride polymer. The rubber polymer may be neoprene, butyl or styrene-butadiene polymer.

As another alternative to using fusible bonding yarns, or in addition to using fusible bonding yarns, a polymer sheet or web is applied to the textile after it leaves the loom and the textile/polymer sheet or web is heated to melt the polymer sheet or web causing the polymer to flow around and encapsulate other components of the textile. The polymer sheet or web is typically in non-woven form. The polymer sheet or web may be a polyester, polyamide, polyolefin or polyurethane sheet or web. Suitable polymer sheets are available commercially from Bemis Associates Inc., Shirley, Mass., as heat seal adhesive films. Suitable polymer webs are available commercially from Bostik Inc., Middleton, Mass. (e.g., Series PE 65 web adhesive).

The bonding process results in chemical and/or mechanical bonds throughout the structure of the textile.

The effect or bulking yarns are used as warp and/or weft yarns and/or knitting yarns. The effect or bulking yarns increase friction with adjacent yarns to provide better stability (fiber to fiber cohesion). Two or more effect or bulking yarns intersecting with one another provide the greatest stability and highest strength. The effect or bulking yarns also provide the desired bulk in the textile and relatively thick profile of the finished product.

The bulking yarns can be broken down into two major categories: (1) continuous multifilament textured yarns and (2) staple fiber spun yarns. Textured yarns are produced from conventional yarns by a known air texturing process. The air texturing process uses compressed air to change the texture of a yarn by disarranging and looping the filaments or fibers that make up the yarn bundle. The texturing process merely rearranges the structure of the yarn bundle with little changes in the basic properties of the individual filaments or fibers occurring. However, the higher the bulk, the higher the loss in strength and elongation. The air jet textured bulking yarns are generally made from low cost, partially oriented, polyester, polyethylene or polypropylene yarns or the like. The individual bulking yarn components will typically have a denier of about 150 to 300, preferably about 300 to about 1,000.

Other types of bulking yarns may be utilized based on staple fibers, particularly polyester staple fibers. The two major types of staple fiber yarns are conventional ring spun yarns and friction spun yarns. Friction spun yarns are produced by a new technology known as friction spinning which is more suitable for large diameter, bulky yarns. Friction spinning machines are made by Dr. Ernst Fehrer AG of Linz, Austria, and are commonly known as DREF 2- and DREF 3-type friction spinning machines. Both conventional ring and DREF friction spinning machines can produce 100% staple fiber yarns as well as core spun yarns. The core spun yarns are made by feeding a high tenacity, heavy denier multifilament yarn into the core of the yarn and spinning a staple fiber yarn (polyester, cotton, acrylic, polypropylene, etc.) around the core yarn. The staple fiber covering (exterior or sheath material) could be conventional polyester or a low melting point material (homo- or bicomponent) staple fiber to produce a multifilament, bulking and fusing composite structure all in one yarn.

Another composite may be formed using air jet texturing in which the load bearing yarn comprises the core and the fusible bonding yarn or bulking yarn is textured. The core is fed with minimal overfeed and with an excess quantity of fusible or bulking yarn with substantially higher overfeed. The compressed air rearranges and loops the filaments or fibers of the fusible yarn or bulking yarn to increase the bulk of the composite yarn. Composite yarns incorporating the load bearing yarn may also be made by known techniques such as twisting or cabling. The fusible yarn, especially of the monofilament type, also may be combined with the bulking yarn prior to textile formation such as by parallel end weaving, or by twisting, cabling or covering (single or double helix cover).

Referring to FIGS. 1–24 again, the fusible bonding yarn would typically be used as the knitting yarn of the knitted textile. However, the fusible bonding yarn could be incorporated into the knitted textiles illustrated in FIGS. 1–24 in many other ways.

The knitting yarns should have a minimum denier of about 300, preferably about 500 to 1,000. The knitting yarns would typically be uncoated multifilaments or extrusion coated multifilaments.

The non-woven textiles which may be incorporated into the knitted structures are typically formed from polyesters or polyolefins. The non-woven textiles may also be made up of 100% fusible bonding fibers having the same composition as the bicomponent yarn used as the fusible bonding yarn, or a combination of fusible fibers with conventional non-fusible fibers such as a uniform blend of such fibers.

Enhanced mechanical keying of the knitted textile may be accomplished by the use of a number of different yarns/fibers (geometry, type, cross-section and combinations thereof) as well as textile structures. Substantial cross-sectional thicknesses can be selectively engineered into the textile structure in the machine and/or cross-machine direction, preferably in the cross-machine direction, by feeding in multiple types and sizes of yarns. For example, a relatively thin profile, compliant weft yarn can be knitted in the cross-machine direction for several inches (4–6 inches), then the knitting machine can be programmed to change to a relatively thick profile, non-compliant weft yarn such as a friction spun/core spun large diameter combination filament/staple fiber multicomposite coarse yarn up to 4,000 tex (cc 0.15) which is stiff, round and non-compressible offering the textile the maximum increase in cross-sectional area. The diameter of the relatively thick profile, non-compliant yarn will typically be about 130 to 300% or more of the diameter of the relatively thin profile, compliant yarn. Correspondingly, in the machine direction, varying types and diameters of yarns can be arranged across the width of the textile to meet the end use requirements.

The engineered placement of radically different yarn types and diameters and knit textile structures directly facilitates enhanced mechanical keying of the textile reinforcement into the soil by changing the surface topography of the textile. Horizontal, vertical, diagonal or other multi-level topographies can be engineered into the textile surface to provide varying degrees of resistance to movement of the load bearing element.

The improved cross-sectional profile can be enhanced by utilizing high twist multifilament plied yarns, high twist multifilament spun yarns, friction spun composite yarns as well as Hamel twist hollow spindle twisted and plied yarns, together with large diameter monofilament and extrusion coated yarns.

Improved initial modulus of the structure can be optimized by Hamel and friction spun/core spun composite yarns with and without fusible fibers in the sheath. Also, the use of hard aqueous dispersible polyurethanes, particularly polycarbonate polyurethanes, with cross-linkers will further increase the modulus. The correct selection of cross-linkers will also improve the flexural and torsional stiffness, adhesion, ultraviolet and hydrolytic stability, and cross-sectional profile of the textile.

Friction spun yarns can be engineered to provide unique combinations of fibers/properties for load bearing yarns, bulking fibers and fusible fibers, and to provide improved strength by protecting high modulus load bearing core yarns from shear forces, friction and degradation.

Air jet textured yarns are compliant and not suitable for the major profile areas, but are ideally suited for the minor profile areas within the textile. Air jet textured yarns could only be used for the major profile areas if plied and heavily twisted to produce round, non-compliant high profile large diameter yarns. In a twisted state, the highly looped fiber structure of the air jet textured yarn would provide textile stability and mechanical keying with the soil environment due to the fiber loops offering increased surface contact.

The porosity/permeability of a knitted textile having a single type of ground structure such as illustrated in FIGS. 14 and 15 can only be controlled by the selection of the yarns and knit geometry. In other words, the porosity/permeability of the textile depends on the size, thickness, and composition of the yarns in combination with the textile structure, i.e., the closeness of the yarns and stitch density, plus the effect of finishing processes. In order to enhance and control the porosity/permeability of the textile, the knitted textile may include various partial threading patterns selectively placed in the textile to enhance and control the porosity/permeability of the textile and to provide relatively high volume flow points at predetermined locations in the textile. For example, the warp yarns may be partially threaded to create laterally spaced warp yarn bundles. As a result, the warp yarn bundles are separated by relatively open longitudinal bands containing only weft yarns. In this construction, the edge warp yarns of each warp yarn bundle will be held in place by an additional knitting yarn controlled by its own guide bar. The weft yarns are usually fully threaded, but could be partially threaded in similar manner to the warp yarns.

Non-woven filtration textiles may be employed with textiles suitable for use as geogrids, as well as with textiles suitable for use as geotextiles such as illustrated in FIGS. 20–22. The non-woven filtration textiles are used for the control of fine particulate matter (soil). The non-woven filtration textiles should have good soil particle retention properties while permitting relatively high water flow. In the case of geotextiles, the non-woven filtration textiles should permit high water flow especially at the high volume flow points.

The knitted textile of the present invention also may include electrically conductive components as warp and/or weft yarns. The electrically conductive components may be metal yarns or strips (e.g., copper), polymeric yarns, either monofilament or multifilament, rendered electrically conductive by adding fillers (e.g., carbon black, copper, aluminum) in the polymer during extrusion, an electrically conductive filament of a multifilament yarn, or a polymeric yarn having an electrically conductive coating. The electrically conductive components permit breaks to be detected in the knitted textile in a known manner. The electrically conductive components also permit failures in other components of a composite civil engineering structure to be detected. The electrically conductive components also permit the knitted textile to be used in electrokinetic and related applications.

The knitted textile of the present invention can be finished by applying heat energy (e.g., calendaring, radio-frequency energy, microwave energy, infra-red energy and tentering) to the textile to soften the fusible yarn (e.g., the sheath of a bicomponent yarn), dry and/or cure the polymer impregnating the textile, or melt the polymer sheet or web to lock the yarns and textile material in place.

The results of the heating or finishing process are:

(a) the textile is protected against impact and abrasion;

(b) the textile is stiffened with better resistance to elongation and with lower ultimate elongation;

(c) the textile is frozen in a fixed bulk for better soil textile interaction; and (d) the textile is protected, strengthened and stiffened.

In accordance with the present invention, a full range of knitted textiles can be engineered from approximately 50 pounds per inch to in excess of 5000 pounds per inch tensile strength. These textiles will possess high strength, low elongation and high structural stability over the full range of tensile strength performance.

Figure 25:
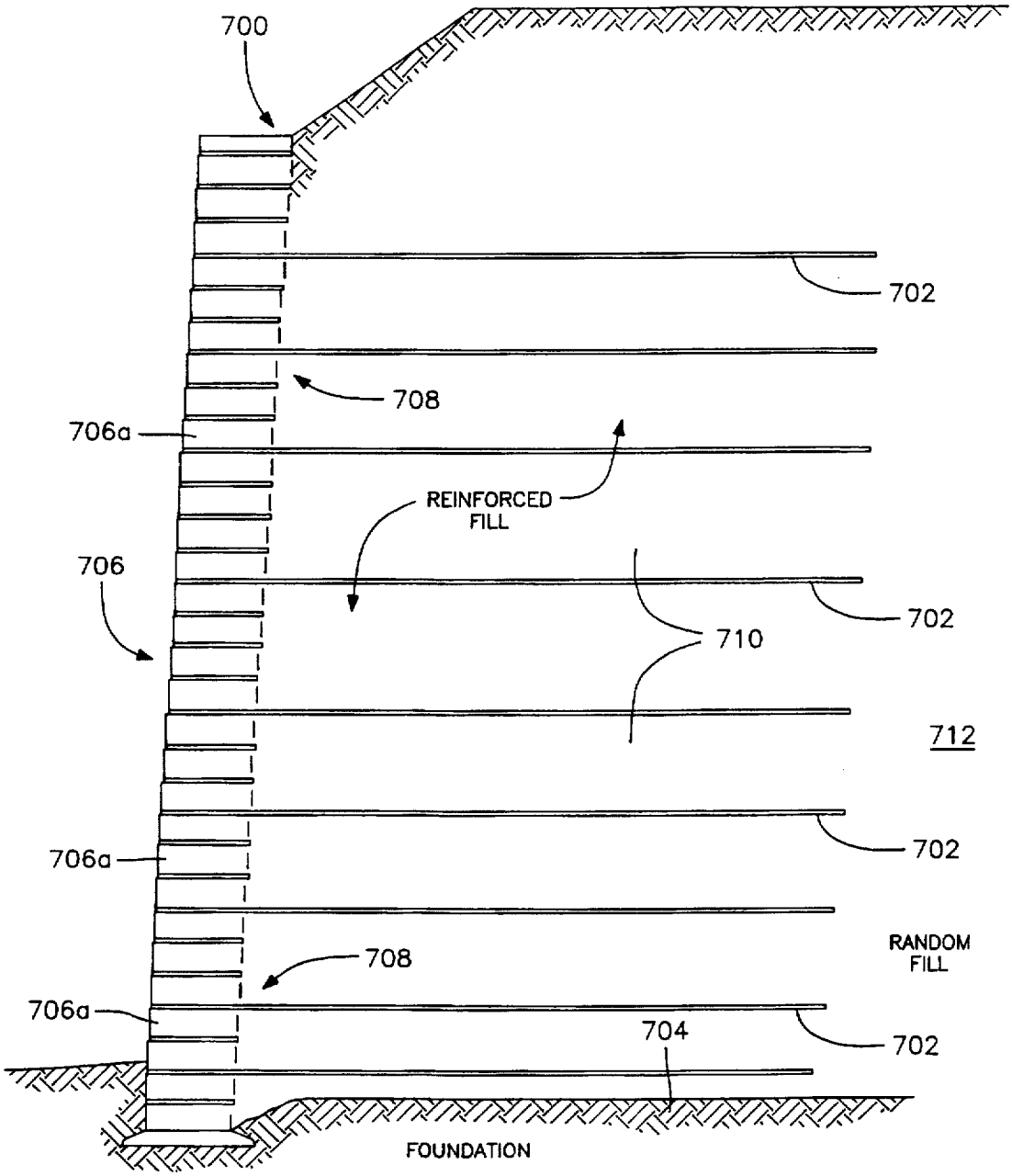
FIG. 25 is a schematic sectional view of a retaining wall formed using bonded composite knitted structural textiles according to the present invention.

FIG. 25 shows a retaining wall 700 formed using bonded composite knitted structural textile 702 of the present invention. Foundation or substrate 704 is graded to a desired height and slope. Retaining wall 706 is formed from a plurality of retaining wall elements 706*a*. A plurality of bonded composite knitted structural textiles 702 are attached to the retaining wall 706 at 708. The bonded composite knitted structural textiles 702 are separated by a plurality of fill layers 710. Using this construction, random fill 712 is retained and held in place.

The retaining wall 706 is illustrated generically as comprising a plurality of courses of modular wall elements 706*a* such as conventional cementitious modular wall blocks. It is to be understood, however, that similar wall structures can be formed using modular wall blocks formed of other materials, including plastic. Likewise, retaining walls incorporating the bonded composite knitted structural textiles of this invention can be constructed with cast wall panels or other conventional facing materials.

While no detail is shown for connection of the bonded composite knitted structural textiles to the retaining wall elements, various techniques are conventionally used, including bodkin connections, pins, staples, hooks or the like, all of which may be readily adapted by those of ordinary skill in the art for use with the bonded composite knitted structural textiles of this invention.

Figure 26:
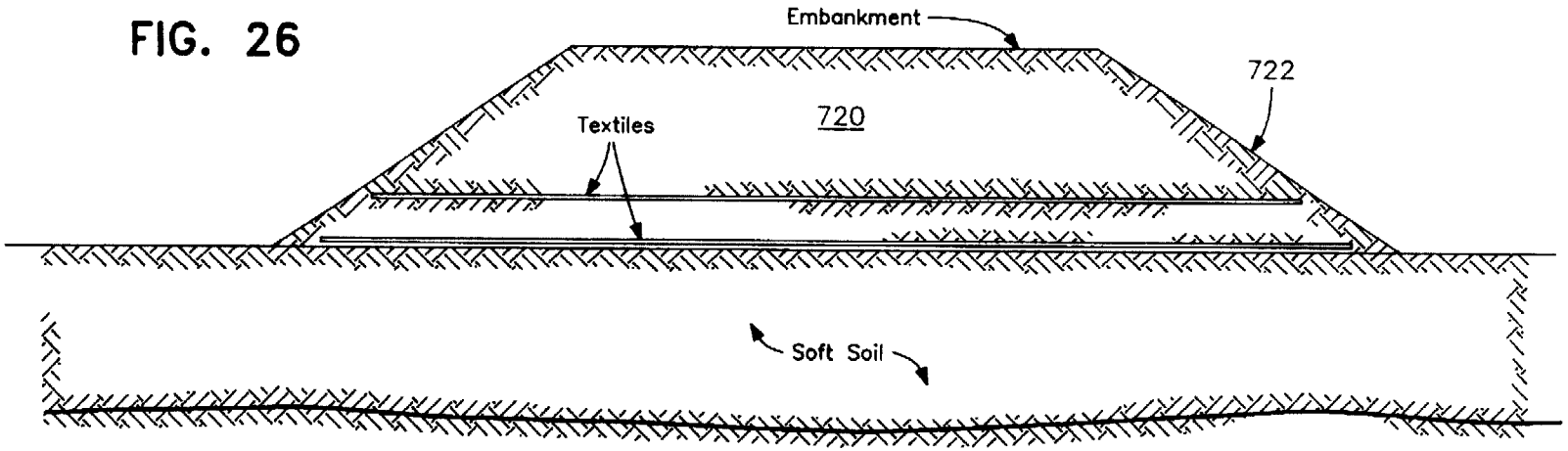
FIG. 26 is a schematic sectional view of a reinforced embankment constructed over weak foundation soils using bonded composite knitted structural textiles according to the present invention.

When embankments are constructed over weak foundation soils, the pressure created by the embankment can cause the soft soil to shear and move in a lateral direction. This movement and loss of support will cause the embankment fill material to shear which results in a failure of the embankment. This type of failure can be prevented by the inclusion of bonded composite knitted structural textiles 720 of the present invention in the lower portions of the embankment 722 as shown in FIG. 26. The bonded composite knitted structural textiles 720 provide tensile strength that prevents the embankment from failing.

Figure 27:
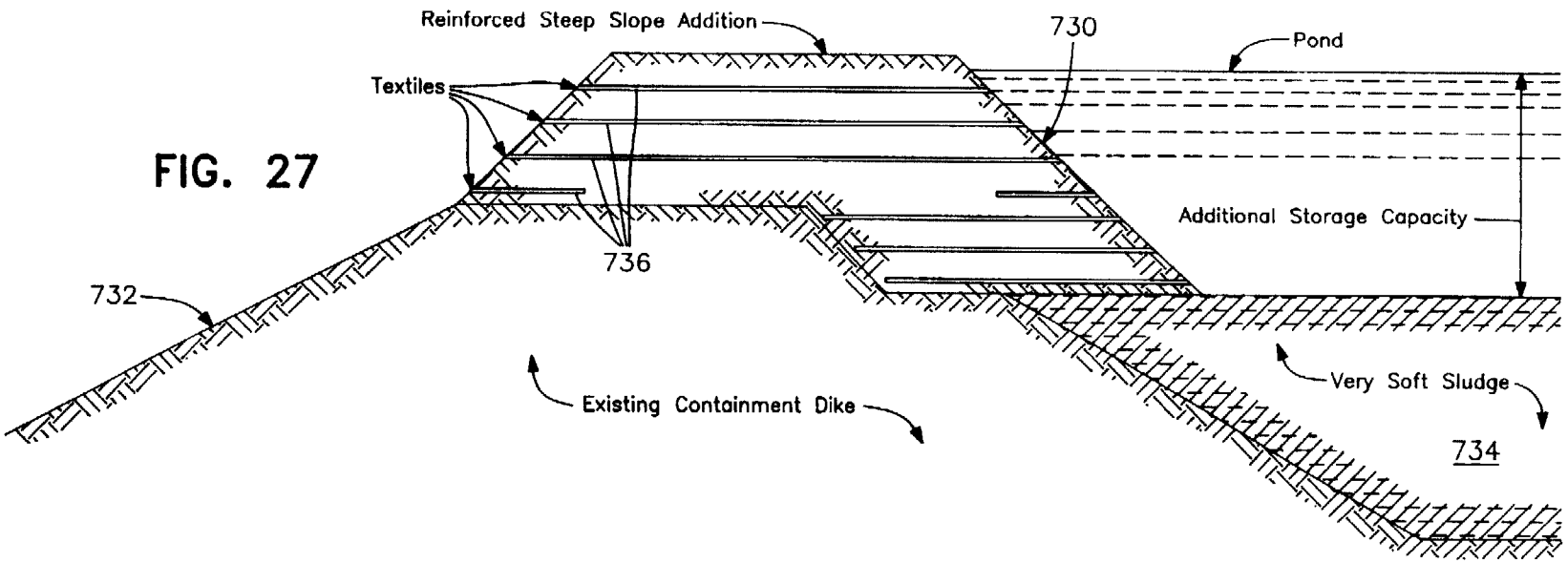
FIG. 27 is a schematic sectional view of reinforced steep slopes which increase the capacity of sludge containment of a sludge containment pond using bonded composite knitted structural textiles according to the present invention.

Reinforced earth structures may be built to steep slope angles which are greater than the natural angle of repose of the fill material by the inclusion of bonded composite knitted structural textiles. Steep slopes can be used in many applications to decrease the amount of fill required for a given earth structure, increase the amount of usable space at the top of the slope, decrease the intrusion of the toe of the slope into wetlands, etc. In FIG. 27, a steep slope dike addition is shown. By using steep slopes 730, the amount of fill required to raise the dike elevation is reduced and the load that is placed on both the existing containment dike 732 and on the soft sludge 734 is also reduced. A dramatic increase in containment capacity is achieved through the use of steep slopes 730 reinforced with bonded composite knitted structural textiles 736 of the present invention.

When embedding the bonded composite knitted structural textiles of this invention in a particulate material such as soil or the like, the particles of aggregate engage the upper and lower surfaces of the textile. Thus, such textile materials are effective to provide a separating or filtering function when embedded in soil or the like.

Figure 28:
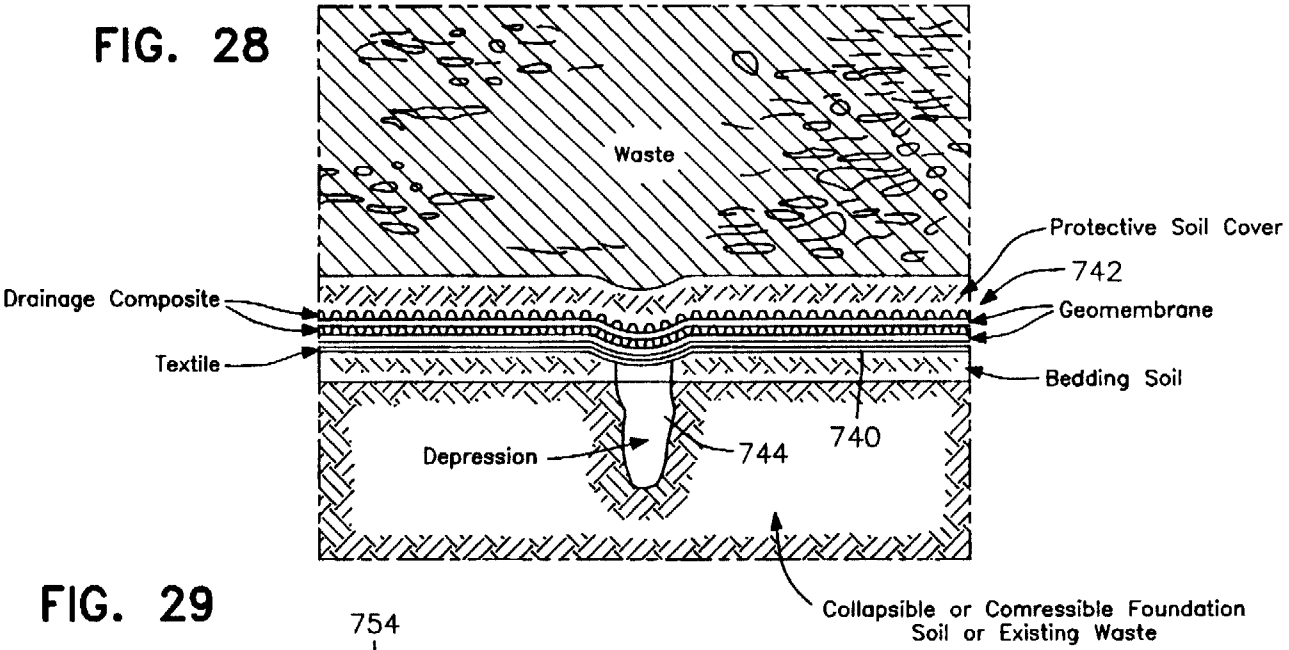
FIG. 28 is a schematic sectional view of a landfill liner support provided by a bonded composite knitted structural textile according to the present invention.

In addition to their earth reinforcement applications, the bonded composite knitted structural textiles of this invention are especially useful in landfill and industrial waste containment constructions. Regulations require that the base and side slopes of landfills be lined with an impermeable layer to prevent the leachate from seeping into natural ground water below the landfill. When landfills are located over terrain which is compressible or collapsible, as in the case of Karst terrain, the synthetic liner will deflect into the depression. This deflection results in additional strains being induced into the liner which can cause failure of the liner and seepage of the leachate into the underlying ground water thus causing contamination. Through the use of the high tensile strength of textile 740 of the present invention as shown in FIG. 28 liner 742 support can be provided by positioning the textile 740 immediately below the liner 742. Should any depression 744 occur, the high tensile capacity of the bonded composite knitted structural textile 740 provides a "bridging"effect to span the depression and to minimize the strain induced into the liner 742 thereby helping to protect the landfill system from failure.

Figure 29:
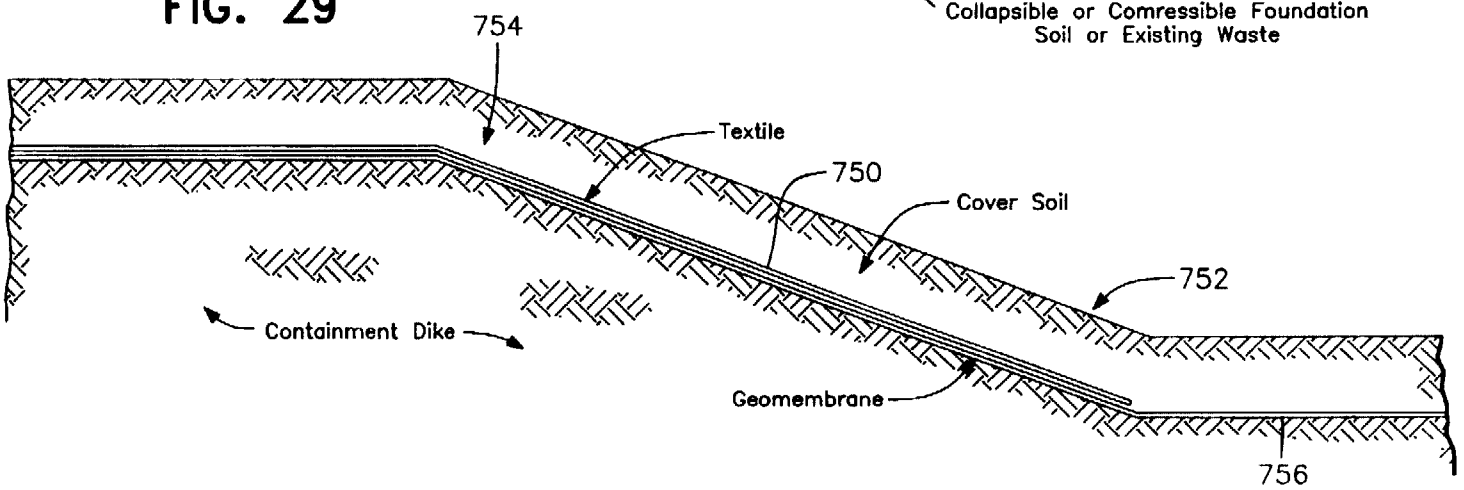
FIG. 29 is a schematic sectional view of a stabilized soil veneer on a sloped liner provided by a bonded composite knitted structural textile according to the present invention.

Construction of landfills requires that the geomembrane liners be placed across the bottom of the landfill and up the side slopes of the landfill as well. In order to protect this liner, a layer of cover soil, known as a veneer, which has a dual purpose of liner protection against punctures from waste material placement and leachate collection is normally placed on top of the liner. Since the surface of the liner is smooth, the cover soil can fail by simply sliding down the slope since the friction between the soil and the liner is too small to support the weight of the soil layer. This type of failure can be prevented by the placement of a textile 750 of the present invention as shown in FIG. 29 anchored at the top and extending down to the toe of the slope 752. The textile 750 provides the tensile force required to hold this block of soil in place, thus eliminating the sliding on the liner 756.

In addition to earth reinforcement applications, and landfill and industrial waste containment applications, the textiles of this invention can be used to produce bags, mats, tubes and the like that can be used for revetment construction when filled either with sand, lean concrete, lean sand asphalt, clay granules, etc. Bags can be placed directly on a slope in a single layer, or they can be stacked in a multiple layer running up the slope. A bag blanket revetment consists of one or two layers of bags placed directly on a slope. A stacked bag revetment consists of bags that are stacked pyramid-fashion at the base of a slope. Mattresses are designed for placing directly on a prepared slope. They are laid in place when empty, joined together and then pumped full of sand or gravel. This results in a mass of pillow-like units. Tubes are filled with sand or clay granules. The highly stabilized textiles of the present invention are ideally suited for use as such bags, mats, tubes and the like. The advantages to the present invention for these applications include lighter weight, lower cost, easier handling and superior (more consistent) hydraulic performance.

Figure 30:
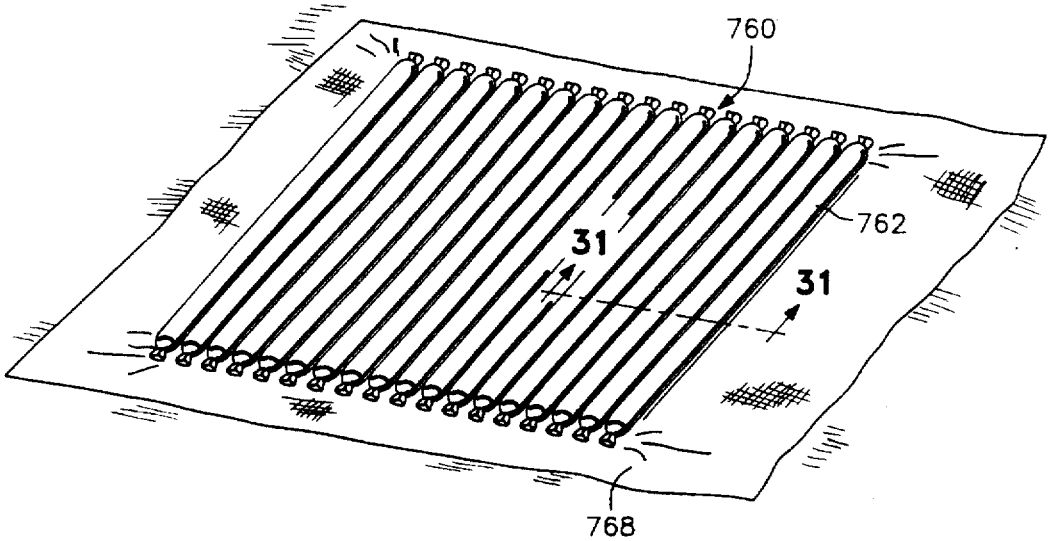
FIG. 30 is a perspective view of a sand or gravel mattress formed of a bonded composite knitted structural textile according to the present invention.
Figure 31:
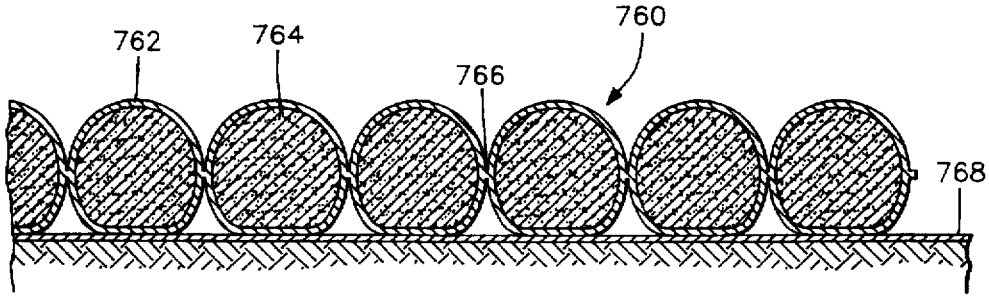
FIG. 31 is a cross-sectional view taken along lines 31—31 in FIG. 30.
Figure 32:
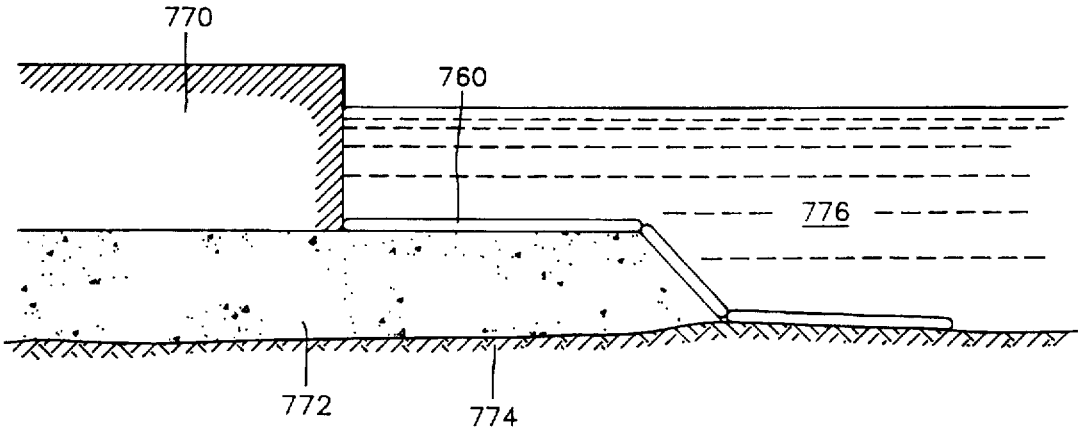
FIG. 32 is a schematic sectional view of a toe protection for a steep-walled caisson structure provided by the sand or gravel mattress of FIG. 30.

FIGS. 30, 31 and 32 illustrate one of the above applications in the form of a mattress. Referring to FIGS. 30 and 31, the mattress 760 comprises a plurality of continuously woven parallel tubes 762 filled with sand or gravel 764. The tubes 762 are interconnected and spaced apart by selvage 766. The tubes 762 typically have a diameter of about 10 inches and a length of several feet (e.g., 25 to 50 feet). The selvage 766 between adjacent tubes 762 may vary from about ½ inch up to several feet (e.g., 10 feet). The selvage 766 at the sides of the mattress 760 may be only a few inches in length (e.g., 5 inches). The mattress 760 is typically positioned on a filter textile 768 as illustrated in FIG. 30. As shown in FIG. 32, the mattress 760 can be used as a toe protection for a steep-walled caisson structure 770 built on a gravel berm 772 over a sea floor 774 for protection form the sea 776.

Bonded composite knitted structural textiles of the present invention also may be used in other applications to reinforce soil or earth structures such as base reinforcement for roadways (e.g., earth, gravel or other particulate materials, base applications, or to reinforce bituminous materials such as asphalt) and airport runways. Additionally, these textiles may be used in the construction of geocells or retaining walls for marine use to control land erosion adjacent to waterways such as rivers, streams, lakes and oceans.

As indicated, while the textile materials of this invention have particular utility in earthwork construction applications, they are also adapted for many applications where textile products have been used heretofore. For example, the novel textiles described herein have excellent strength and related characteristics for use in the formulation of gabions. Additionally, they may be readily adapted for use as industrial belting, restraint systems and the like.

Having described the invention, many modifications thereto will become apparent to those skilled in the art to which it pertains without deviation from the spirit of the invention as defined by the scope of the appended claims.

We claim:

1. A bonded composite knitted structural textile, comprising:

a knitted structure of open mesh or closely knit form including knitted yarn associated with a plurality of laid-in weft and warp yarns;

a portion of the warp and/or weft yarns comprising load bearing yarns, the load bearing yarns being high tenacity, high modulus, low elongation yarns; and the bonded composite knitted structural textile comprising at least one polymer component encapsulating and bonding adjacent yarns at junctions of the laid-in weft and warp yarns to improve the structural integrity, initial modulus, stiffness and durability of the textile.

2. The bonded composite knitted structural textile of claim 1, wherein the knitted structure comprises a weft insertion warp knitted structure.

3. The bonded composite knitted structural textile of claim 1, wherein the knitted structure comprises a warp insertion weft knitted structure.

4. The bonded composite knitted structural textile of claim 1, wherein the knitted structure comprises a warp and weft insertion knitted structure.

5. The bonded composite knitted structural textile of claim 1, wherein the polymer component is formed by a fusible polymer component of a fusible bonding yarn which melts when heated and flows around adjacent yarns.

6. The bonded composite knitted structural textile of claim 5, wherein the fusible bonding yarn is a bicomponent yarn having a low melting temperature fusible component and a high melting temperature component.

7. The bonded composite knitted structural textile of claim 6, wherein the bicomponent yarn is composed of 30 to 70% by weight of the low melting temperature fusible component and 70 to 30% by weight of the high melting temperature component.

8. The bonded composite knitted structural textile of claim 5, wherein the fusible bonding yarn comprises at least a portion of a non-woven filtration textile incorporated into the knitted structure.

9. The bonded composite knitted structural textile of claim 5, wherein the fusible bonding yarn comprises a portion of the warp and/or weft yarns and/or knitted yarn.

10. The bonded composite knitted structural textile of claim 1, wherein the polymer component is formed by a polymer impregnating the yarns which dries and/or cures when heated or by a polymer sheet or web which melts when heated.

11. The bonded composite knitted structural textile of claim 10, wherein the polymer impregnating the yarns is a urethane, acrylic, vinyl or rubber and the polymer sheet or web is a polyester, polyamide, polyolefin or polyurethane sheet or web.

12. The bonded composite knitted structural textile of claim 1, wherein a portion of the warp and weft yarns comprise bulking yarns to provide a relatively thick profile for the knitted textile.

13. The bonded composite knitted structural textile of claim 12, wherein the bulking yarns are produced form partially oriented polyester, polyethylene or polypropylene yarns.

14. The bonded composite knitted structural textile of claim 1, wherein the load bearing yarns are composite yarns in which the load bearing yarn is combined with a fusible bonding yarn or a bulking yarn.

15. The bonded composite knitted structural textile of claim 14, wherein the composite yarns are formed by air jet texturing.

16. The bonded composite knitted structural textile of claim 14, wherein the composite yarns are formed by twisting, cabling, covering or core spinning.

17. The bonded composite knitted structural textile of claim 1, wherein the load bearing yarns have a strength of at least about 5 grams per denier, a modulus of at least about 100 grams per denier, and an elongation of less than about 18%.

18. The bonded composite knitted structural textile of claim 1, wherein the load bearing yarns have a strength of at least about 9 to 10 grams per denier, a modulus of at least about 100 grams per denier, and an elongation of less than about 18%.

19. The bonded composite knitted structural textile of claim 1, wherein the load bearing yarns have a denier of about 1,000 to 18,000 and the knitted yarn has a denier of at least about 300.

20. The bonded composite knitted structural textile of claim 1, wherein the load bearing yarns are formed from polyester, polyvinylalcohol, nylon, aramid, fiberglass or polyethylene naphthal ate.

21. The bonded composite knitted structural textile of claim 1, wherein the knitting yarn further comprising a second knitting yarn, the second knitting yarn being threaded 1 in 1 out.

22. The bonded composite knitted structural textile of claim 21, wherein the stitches in each wale are formed in a patterned arrangement with selected stitches being formed by one yarn and other stitches being formed by two yarns.

23. The bonded composite knitted structural textile of claim 22, wherein the underlaps of the second knitting yarn have varying lengths.

24. The bonded composite knitted structural textile of claim 22, wherein the second knitting yarn forms a combination of closed lap and open lap stitches.

25. The bonded composite knitted structural textile of claim 1, wherein the textile has a high initial modulus.

26. The bonded composite knitted structural textile of claim 1, wherein the textile has substantial cross-sectional thicknesses selectively engineered into the textile to enhance mechanical keying and/or frictional interfacing when embedded in construction fill or similar materials.

27. The bonded composite knitted structural textile of claim 26, wherein the textile includes relatively thick profile, non-compliant yarns and relatively thin profile, compliant yarns to form the substantial cross-sectional thicknesses.

28. The bonded composite knitted structural textile of claim 26, wherein the diameter of the relatively thick profile, non-compliant yarns is about 130 to 300% or more of the diameter of the relatively thin profile, compliant yarns.

29. The bonded composite knitted structural textile of claim 26, wherein the relatively thick profile, non-compliant yarns are core spun, friction spun, or ring spun yarns, Hamel twist covered yarns or covered yarns with a single or double helix and the relatively thin profile, compliant yarns are normal single or twisted and plied yarns.

30. The bonded composite knitted structural textile of claim 1, wherein the textile is used as a geotextile.

31. The bonded composite knitted structural textile of claim 30, wherein the textile contains up to about 10% open area in a regularly distributed pattern over the textile.

32. The bonded composite knitted structural textile of claim 30, wherein the textile has areas of enhanced permeability.

33. The bonded composite knitted structural textile of claim 30, wherein the textile has regularly distributed high volume flow points distributed throughout the textile at predetermined points.

34. The bonded composite knitted structural textile of claim 33, wherein the textile is associated with a non-woven filtration textile for the control of fine particulate matter while permitting high water flow throughout the textile particularly at the high volume flow points.

35. The bonded composite knitted structural textile of claim 1, wherein the textile is used as a geogrid.

36. The bonded composite knitted structural textile of claim 32, wherein the geogrid contains at least 50% open area.

37. The bonded composite knitted structural textile of claim 32, wherein the geogrid is associated with a non-woven filtration textile for the control of fine particulate matter while permitting high water flow.

38. A composite civil engineering structure comprising a mass of particulate material and at least one reinforcing element embedded therein, wherein said reinforcing element is a bonded composite knitted structural textile according to claim 1, portions of said mass of particulate material being below said reinforcing textile and portions of said mass of particulate material being above said reinforcing textile.

39. The composite civil engineering structure of claim 38, wherein portions of said mass of reinforcing material are within openings defined between bundles of adjacent weft and warp yarns.

40. The composite civil engineering structure of claim 38, further including a retaining wall, portions of said reinforcing textile being secured to said retaining wall, said mass of particulate material, said reinforcing textile and said retaining wall together defining a reinforced retaining wall.

41. The composite civil engineering structure of claim 40, comprising a plurality of said reinforcing textiles in vertically spaced relationship.

42. The composite civil engineering structure of claim 38, wherein said mass of particulate material and reinforcing textile together define a stabilized embankment.

43. The composite civil engineering structure of claim 42, comprising a plurality of said reinforcing textiles in vertically spaced relationship.

44. The composite civil engineering structure of claim 38, wherein said mass of particulate material and reinforcing textile together constitute an internally reinforced steep earth slope.

45. The composite civil engineering structure of claim 44, comprising a plurality of said reinforcing textiles in vertically spaced relationship.

46. The composite civil engineering structure of claim 44, wherein said steep earth slope is a dike addition to raise the dike elevation of a containment dike.

47. The composite civil engineering structure of claim 38, wherein said mass of particulate material and reinforcing grid together with a liner define a landfill.

48. The composite civil engineering structure of claim 47, wherein said landfill is for terrain which is compressible or collapsible and said reinforcing textile is positioned immediately below said liner.

49. The composite civil engineering structure of claim 47, wherein said landfill includes a side slope and said reinforcing textile is anchored at a top of said slope and extends down to a toe of said slope, said reinforcing textile being positioned above said liner.

50. A method of constructing a composite civil engineering structure comprising:

providing a mass of particulate material, providing at least one bonded composite knitted structural textile according to claim 1, and embedding said reinforcing textile in said mass of particulate material with portions of said mass of particulate material being below said reinforcing textile and portions of said mass of particulate material being above said reinforcing textile.

51. The method of constructing a composite civil engineering structure of claim 50, wherein portions of said mass of particulate material are within openings defined between bundles of adjacent weft and warp yarns.

52. The method of constructing a composite civil engineering structure of claim 50, further including providing a retaining wall, securing portions of said reinforcing textile to said retaining wall, said mass of particulate material, said reinforcing textile and said retaining wall together defining a reinforced retaining wall.

53. The method of constructing a composite civil engineering structure of claim 52, comprising embedding a plurality of said reinforcing textiles in said mass of particulate material in vertically spaced relationship.

54. The method of constructing a composite civil engineering structure of claim 50, wherein said mass of particulate material and reinforcing textile together define a stabilized embankment.

55. The method of constructing a composite civil engineering structure of claim 54, comprising embedding a plurality of said reinforcing textiles in said mass of particulate material in vertically spaced relationship.

56. The method of constructing a composite civil engineering structure of claim 50, wherein said mass of particulate material and reinforcing textile together define a steep slope.

57. The method of constructing a composite civil engineering structure of claim 56, comprising embedding a plurality of said reinforcing textiles in said mass of particulate material in vertically spaced relationship.

58. The method of constructing a composite engineering structure of claim 56, wherein said steep slope is a dike addition to raise the dike elevation of a containment dike.

59. The method of constructing a composite civil engineering structure of claim 50, wherein said mass of particulate material and reinforcing textile together with a liner define a landfill.

60. The method of constructing a composite civil engineering structure of claim 59, wherein said landfill is for terrain which is compressible or collapsible and said reinforcing textile is embedded in said mass of particulate material immediately below said liner.

61. The method of constructing a composite civil engineering structure of claim 59, wherein said landfill includes a side slope and said reinforced textile is anchored at a top of said slope and extends down to a toe of said slope, said reinforcing textile being embedded in said mass of particulate material above said liner.

62. A bonded composite knitted structural textile, comprising:

a plurality of spaced apart knitted structures of open mesh form including knitted yarn associated with a plurality of laid-in weft and warp yarns;

the plurality of laid-in weft and warp yarns intersecting at a plurality of junctions to define openings therebetween;

a portion of the warp and/or weft yarns comprising load bearing yarns, the load bearing yarns being high tenacity, high modulus, low elongation yarns; and the junctions of the laid-in weft and warp yarns of the bonded composite knitted structural textile comprising at least one polymer component encapsulating and bonding yarns at the junctions to improve the structural integrity, initial modulus, stiffness and durability of the textile.

63. The bonded composite knitted structural textile of claim 62, wherein the knitted structures comprise weft insertion warp knitted structures.

64. The bonded composite knitted structural textile of claim 62, wherein the knitted structures comprise warp insertion weft knitted structures.

65. The bonded composite knitted structural textile of claim 62, wherein the knitted structures comprise warp and weft insertion knitted structures.

66. The bonded composite knitted structural textile of claim 62, wherein the polymer component is formed by a fusible polymer component of a fusible bonding yarn which melts when heated and flows around adjacent yarns.

67. The bonded composite knitted structural textile of claim 66, wherein the fusible bonding yarn is a bicomponent yarn having a low melting temperature fusible component and a high melting temperature component.

68. The bonded composite knitted structural textile of claim 67, wherein the bicomponent yarn is composed of 30 to 70% by weight of the low melting temperature fusible component and 70 to 30% by weight of the high melting temperature component.

69. The bonded composite knitted structural textile of claim 62, wherein the fusible bonding yarn comprises the knitted yarn.

70. The bonded composite knitted structural textile of claim 62, wherein the fusible bonding yarn comprises a portion of the warp and/or weft yarns.

71. The bonded composite knitted structural textile of claim 62, wherein the polymer component is formed by a polymer impregnating the yarns which dries and/or cures when heated or by a polymer sheet or web which melts when heated.

72. In a bonded composite knitted structural textile having a knitted structure of open mesh or closely knit form, the improvement comprising:

load bearing yarns defining at least a portion of the textile, the load bearing yarns being high tenacity, high modulus, low elongation yarns; and at least one fusible bonding yarn which has bonding fiber and a fusible polymer component which will melt when heated to flow around, encapsulate and bond adjacent yarns to improve the structural integrity, initial modulus, stiffness and durability of the textile.

73. The bonded composite knitted structural textile of claim 72, wherein the fusible yarn is a bicomponent yarn having a low melting temperature fusible component and a high melting temperature component.

74. The bonded composite knitted structural textile of claim 72, wherein the load bearing yarns have a strength of at least about 5 grams per denier, a modulus of at least about 100 grams per denier and an elongation of less than about 18%.

75. The bonded composite knitted structural textile of claim 72, wherein the load bearing yarns have a strength of at least about 9 to 10 grams per denier, a modulus of at least about 100 grams per denier, and an elongation of less than about 18%.

76. The bonded composite knitted structural textile of having a knitted structure of claim 72, wherein the load bearing yarns have a denier of about 1,000 to 18,000.

77. The bonded composite knitted structural textile of claim 72, wherein the load bearing yarns are formed from polyester, vinylalcohol, nylon, aramid, fiberglass or polyethylene napthalate.

78. A bonded composite knitted structural textile, comprising:

a knitted grid including knitted yarn associated with a plurality of laid-in weft and/or warp yarns;

a portion of the warp and/or weft yarns comprising load bearing yarns, the load bearing yarns being high tenacity, high modulus, low elongation yarns; and the bonded composite knitted structural textile comprising at least one fusible polymer component, said fusible polymer component having been derived from a fusible polymer component containing bonding fiber encapsulating and bonding adjacent yarns at junctions of the grid to strengthen the textile.

79. A bonded composite knitted structural textile, comprising:

a grid having a plurality of spaced apart knitted structures including knitted yarn associated with a plurality of laid-in weft and/or warp yarns;

the plurality of knitted structures intersecting at a plurality of junctions to define openings therebetween;

a portion of the warp and/or weft yarns comprising load bearing yarns, the load bearing yarns being high tenacity, high modulus, low elongation yarns; and the junctions of the bonded composite knitted structural textile comprising at least one fusible polymer component, said fusible polymer component having been derived from a fusible polymer component containing bonding fiber encapsulating and bonding yarns at the junctions of the grid to strengthen the textile.

80. In a bonded composite knitted structural textile defining a knitted grid, the improvement comprising:

load bearing yarns defining at least a portion of the grid, the load bearing yarns being high tenacity, high modulus, low elongation yarns; and at least one fusible bonding yarn which has bonding fiber and a fusible polymer component which will melt when heated to flow around, encapsulate and bond adjacent yarns at the junctions of the grid to strengthen the textile.

* * * * *